US006265142B1

(12) United States Patent
Nakagawa et al.

(10) Patent No.: US 6,265,142 B1
(45) Date of Patent: Jul. 24, 2001

(54) HEAT DEVELOPABLE COLOR PHOTOGRAPHIC LIGHT-SENSITIVE MATERIAL

(75) Inventors: Hajime Nakagawa; Toshiki Taguchi, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/253,766

(22) Filed: Feb. 22, 1999

(30) Foreign Application Priority Data

Feb. 20, 1998 (JP) ..... 10-039324

(51) Int. Cl.[7] ..... G03C 1/42

(52) U.S. Cl. ..... 430/544; 430/467; 430/470; 430/543

(58) Field of Search ..... 430/544, 467, 430/470, 543, 570

(56) References Cited

U.S. PATENT DOCUMENTS 4,500,626 * 2/1985 Naito et al. ..... 430/203
4,559,290 12/1985 Sawada et al. ..... 430/203
4,696,887 * 9/1987 Sato et al. .
4,782,004 * 11/1988 Takeuchi et al. .
5,468,587 * 11/1995 Bailey et al. .
5,716,772 * 2/1998 Taguchi ..... 430/543

FOREIGN PATENT DOCUMENTS 63-046450 * 2/1988 (JP) .

* cited by examiner

*Primary Examiner*—Hoa Van Le
*Assistant Examiner*—Amanda C. Walke
(74) *Attorney, Agent, or Firm*—Sughrue, Mion, Zinn, Macpeak & Seas, PLLC

(57) ABSTRACT

A heat developable color photographic light-sensitive material comprising at least one dye providing compound represented by the formula (L1) shown below and at least one developing agent represented by the formula (1) or (2) shown below:

(1)

(2)

The symbols in the above formulae are defined and described in detail in the specification.

20 Claims, No Drawings

HEAT DEVELOPABLE COLOR PHOTOGRAPHIC LIGHT-SENSITIVE MATERIAL

FIELD OF THE INVENTION

The present invention relates to a heat developable color photographic light-sensitive material, more particularly to a heat developable color photographic light-sensitive material which provides excellent images upon development for a very short time and which is excellent in preservation stability before imagewise exposure.

BACKGROUND OF THE INVENTION

The heat developable color light-sensitive materials are known in the field of art. For instance, methods for forming dye images by a coupling reaction of an oxidation product of a developing agent with a coupler are described, for example, in U.S. Pat. Nos. 3,761,270 and 4,021,240. Also, methods for forming positive color images by a light-sensitive silver dye bleach process are described, for example, in U.S. Pat. No. 4,235,957.

Further, a method has recently been proposed in which a diffusible dye is released or formed imagewise by heat development and the diffusible dye is transferred onto a dye fixing element. According to the method, either a negative dye image or a positive dye image can be obtained by changing the kind of dye providing compound used or the kind of silver halide used. More details thereof are described, for example, in U.S. Pat. Nos. 4,500,626, 4,483,914, 4,503,137 and 4,559,290, JP-A-58-149046 (the term "JP-A" as used herein means an "unexamined published Japanese patent application"), JP-A-60-133449, JP-A-59-218443, JP-A-61-238056 and EP-A-210,660.

Many methods for obtaining positive color images upon heat development have been proposed. For instance, in U.S. Pat. No. 4,559,290, a method is described wherein an oxidized compound, which in its oxidized state does not have a dye releasing ability, obtained by converting a so-called DRR compound, is coexistent with a reducing agent (including a precursor thereof), the reducing agent is oxidized in correspondence to an exposure amount of silver halide upon heat development, and the oxidized compound is reduced with the remaining reducing agent which has been not oxidized, whereby a diffusible dye is released. Further, in U.S. Pat. No. 4,783,396 and *Kokai Giho* 87-6199 (Vol. 12, No. 22), a heat developable color light-sensitive material containing, as a compound capable of releasing a diffusible dye in a similar mechanism, a compound which can release a diffusible dye upon reductive cleavage of an N—X bond (wherein X represents an oxygen atom, a nitrogen atom or a sulfur atom) is described.

On the other hand, progress on computer graphics is remarkable in recent years as described, for example, in *Eizojoho,* edited by Kunigome Takeshi, October, 1993 published by Sangyo Kaihatsu Kiko Co., Ltd., and in order to output such image information, various systems of color printers (color hard copiers) of high image quality have been developed. For instance, printers for heat developable color light-sensitive materials using silver halide such as Pictrography 3000 and Pictrostat Digital 400 manufactured by Fuji Photo Film Co., Ltd. are commercially available.

Since negative-positive conversion is digitally conducted in these devices, conventional DRR compounds can be employed as they are in light-sensitive materials and images excellent in discrimination are available.

Although images having excellent image quality can be obtained in a short period of time using such light-sensitive materials, more rapid processing has been desired in a market place, recently. Processing at higher temperature is attempted in order to reduce the processing time. However, control of a period of time for processing is difficult under such a condition and unevenness of image occurs in some cases.

On the other hand, a technique for accelerating development by adding a reducing agent such as phenidone as an electron transfer agent is known for a long time. However, when such known reducing agents are used, problems, for example, degradation of stability of light-sensitive material, increase in density of white background area and decrease in color separation tend to occur.

SUMMARY OF THE INVENTION

Therefore, an object of the present invention is to provide a silver halide color photographic light-sensitive material which provides images excellent in discrimination upon development processing for a very short time and which is excellent in preservation stability.

Other objects of the present invention will become apparent from the following detailed description and examples.

It has been found that these objects of the present invention are accomplished with a heat developable color photographic light-sensitive material comprising at least one dye providing compound represented by the formula (L1) shown below and at least one developing agent represented by the formula (1) or (2) shown below:

$$(\text{Dye-X})_q\text{—Y} \qquad \text{(L1)}$$

wherein Dye represents a dye moiety, a dye moiety temporarily shifted to a short wavelength or a dye precursor; X represents a mere bond or connecting group; Y represents a group having a property of bringing about the difference in diffusibility of the compound represented by $(\text{Dye-X})_q$—Y corresponding to or reversely corresponding to a light-sensitive silver salt having imagewise a latent image, or releasing Dye to generate the difference in diffusibility between Dye released and the compound represented by $(\text{Dye-X})_q$—Y; and q represents 1 or 2, and when q is 2, two Dye-X groups may be the same or different;

(1)

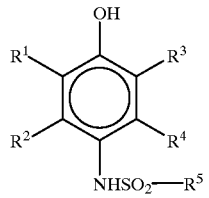

(2)

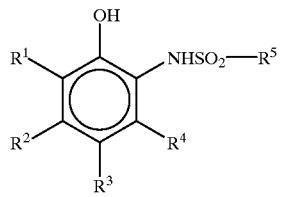

wherein $R^1$, $R^2$, $R^3$ and $R^4$, which may be the same or different, each represents a hydrogen atom, a halogen atom, a cyano group or an alkyl, aryl, heterocyclic, alkoxy, aryloxy, alkylthio, arylthio, alkylcarbonyl, arylcarbonyl, alkylsulfonyl, arylsulfonyl, alkylcarbonamido, arylcarbonamido, alkylsulfonamido, arylsulfonamido, alkylcarbonyloxy, arylcarbonyloxy, carbamoyl, alkylcarbamoyl, arylcarbamoyl, alkoxycarbonyl, aryloxycarbonyl, sulfamoyl, alkylsulfamoyl, arylsulfamoyl, ureido or urethane group having not more than 4 carbon atoms or an I/O value of not less than 1; and $R^5$ represents an alkyl group, an aryl group, a heterocyclic group, an alkylamino group, an arylamino group or a heterocyclic amino group.

DETAILED DESCRIPTION OF THE INVENTION

The dye providing compound represented by the formula (L1) will be described in more detail below.

Dye represents a dye moiety having one or more dyes or dye precursors, and q represents 1 or 2 and when q is 2, two Dye-X groups may be the same or different. Preferably, q is 1.

X represents a mere bond or a linking group which is dissociated corresponding to or reversely corresponding to development. Representative examples of the linking group represented by X include a group represented by —$N(J_1)$— (wherein $J_1$ represents a hydrogen atom, an alkyl group or a substituted alkyl group), —$SO_2$—, —CO—, an alkylene group, a substituted alkylene group, a phenylene group, a substituted phenylene group, a naphthylene group, a substituted naphthylene group, —O—, —SO—and a group obtained by combining two or more of these divalent groups. Among these, a group represented by —$N(J_1)$—$SO_2$—, a group represented by —$N(J_1)$—CO— and a group represented by —$J_2$—$(L)_k$—$(J_3)_r$—, wherein $J_2$ and $J_3$ each represents an alkylene group, a substituted alkylene group, a phenylene group, a substituted phenylene group, a naphthylene group or a substituted naphthylene group; L represents —O—, —SO—, —$SO_2$—, —CO—, —$SO_2$NH—, —CONH— or —NHCO—; k represents 0 or 1; and r represents 1 or 0 are preferred. A combination of —$N(J_1)$—$SO_2$— or —$N(J_1)$—CO— with —$J_2$—$(L)_k$—$(J_3)_r$— is also preferred.

In the formula (L1), it is particularly preferred that Dye and Y are connected in the form of Dye-$SO_2$NH—Y.

Now, Y in the formula (L1) is described below.

Y represents a group having a property of dissociating the Y—X bond corresponding to or reversely corresponding to a light-sensitive silver halide having a latent image. Such a group is known in the field of photographic chemistry utilizing diffusion transfer of a dye and examples thereof are described in U.S. Pat. No. 5,021,334 (corresponding to JP-A-2-184852).

Y is described in detail. In the formulae described below, X is also included.

(1) First, Y includes a negative acting releaser which releases a photographically useful group corresponding to development.

Known examples of Y classified into the negative acting releaser include a group of releasers which each releases a photographically useful group from an oxidation product.

Y of this type is preferably represented by the following formula (Y-1).

(Y-1)

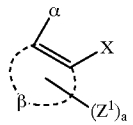

wherein β represents a nonmetallic atomic group necessary for forming a benzene ring, the benzene ring may be condensed with a saturated or unsaturated carbon ring or heterocyclic ring; α represents —$OZ^2$ or —$NHZ^3$, wherein $Z^2$ represents a hydrogen atom or a group which generates a hydroxyl group by hydrolysis; and $Z^3$ represents a hydrogen atom, an alkyl group, an aryl group or a group which generates an amino group by hydrolysis; $Z^1$ represents an alkyl group, an aryl group, an aralkyl group, an alkoxy group, an alkylthio group, an aryloxy group, an arylthio group, an acyl group, a sulfonyl group, an acylamino group, a sulfonylamino group, a carbamoyl group, a sulfamoyl group, a ureido group, a urethane group, a heterocyclic group, which groups each may have a substituent, a cyano group or a halogen atom; a represents a positive integer, and when two or more $Z^1$ groups are present, they may be the same or different; and X represents a group represented by —$NHSO_2Z^4$, wherein $Z^4$ represents a divalent group.

Among the groups represented by formula (Y-1), those represented by the following formula (Y-2) or (Y-3) are preferred.

(Y-2)

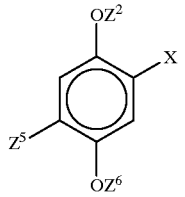

(Y-3)

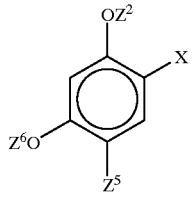

wherein $Z^2$ and X each has the same meaning as defined in formula (Y-1); and $Z^5$ and $Z^6$ each represents an alkyl group, an aryl group or an aralkyl group, which groups each may have a substituent.

More preferably, $Z^5$ is a secondary or tertiary alkyl group and the total number of carbon atoms included in $Z^5$ and $Z^6$ is from 20 to 50.

Specific examples thereof include those described in U.S. Pat. Nos. 4,055,428 and 4,336,322, JP-A-51-113624, JP-A-56-16131, JP-A-56-71061, JP-A-56-71060, JP-A-56-71072, JP-A-56-73057, JP-A-57-650, JP-A-57-4043, JP-A-59-60439, JP-B-56-17656 (the term "JP-B" as used herein means an "examined Japanese patent publication") and JP-B-60-25780.

Another example of Y is a group represented by the following formula (Y-4).

(Y-4)

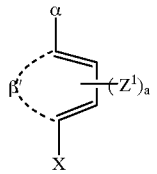

wherein α, X, $Z^1$ and a each has the same meaning as defined in formula (Y-1); and β' represents a nonmetallic atomic group necessary for forming a benzene ring, and the benzene ring may be condensed with a saturated or unsaturated carbon ring or heterocyclic ring.

Among the groups represented by formula (Y-4), those wherein α is —$OZ^2$ and β' forms a naphthalene skeleton are preferred. Specific examples thereof include those described in U.S. Pat. Nos. 3,928,312 and 4,135,929.

Examples of the releaser which releases a photographically useful group by the same reaction as in the case of formula (Y-1) or (Y-2) include the groups described in JP-A-51-104343, JP-A-53-46730, JP-A-54-130122, JP-A-57-85055, JP-A-53-3819, JP-A-54-48534, JP-A-49-64436, JP-A-57-20735, JP-B-48-32129, JP-B-48-39165 and U.S. Pat. No. 3,443,934.

The compound which releases a photographically useful group from an oxidation product in a different mechanism, includes hydroquinone derivatives represented by the following formulae (Y-5) and (Y-6).

(Y-5)

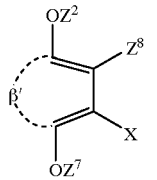

(Y-6)

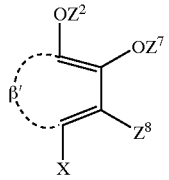

wherein β' has the same meaning as defined in formula (Y-4); $Z^2$ has the same meaning as defined in formula (Y-1); $Z^7$ has the same meaning as $Z^2$; $Z^8$ represents a substituent described for $Z^1$ or a hydrogen atom; and $Z^2$ and $Z^7$ may be the same or different. Specific examples of the compound are described in U.S. Pat. No. 3,725,062.

The above-described hydroquinone derivative releaser may have a nucleophilic group in the molecule thereof. Specific examples thereof are described in JP-A-4-97347.

Other examples of Y include p-hydroxydiphenylamine derivatives described in U.S. Pat. No. 3,443,939 and hydrazine derivatives described in U.S. Pat. Nos. 3,844,785 and 4,684,604, and *Research Disclosure,* No. 128, page 22.

The positive acting releaser also includes those which are incorporated into a light-sensitive material in a reduced form and deactivated upon oxidation at the time of processing.

Examples of the releaser of this type include Fields compounds described in JP-A-51-63618 and U.S. Pat. No. 3,980,479 and Hinshaw compounds described in JP-A-49-111628, JP-A-52-4819 and U.S. Pat. No. 4,199,354.

Examples of Y of this type also include a group represented by the following formula (Y-7).

(Y-7)

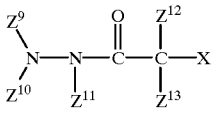

wherein $Z^9$ and $Z^{11}$ each represents a hydrogen atom, a substituted or unsubstituted acyl, alkoxycarbonyl or aryloxycarbonyl group; $Z^{10}$ represents an alkyl group, an aryl group, an aralkyl group, an acyl group, an alkoxycarbonyl group, an aryloxycarbonyl group, a carbamoyl group, a sulfonyl group or a sulfamoyl group; $Z^{12}$ and $Z^{13}$ each represents a hydrogen atom, a substituted or unsubstituted alkyl, aryl or aralkyl group. Specific examples of the group include those described in JP-A-62-245270 and JP-A-63-46450.

The positive acting releaser having a different mechanism includes a thiazolidine type releaser. Specific examples thereof are described in U.S. Pat. No. 4,468,451 and JP-A-7-159962.

Specific examples of the dye providing compound represented by the formula (L1) include compounds classified in Groups (1) to (3) described below. Compounds in Groups (1) to (2) are those which form a diffusible dye image (positive dye image) reversely corresponding to development of silver halide, and compounds in Group (3) are those which form a diffusible dye image (negative dye image) corresponding to development of silver halide.

(1) A dye developer in which a hydroquinone type developing agent and a dye component are connected to each other as described, for example, in U.S. Pat. Nos. 3,134,764, 3,362,819, 3,597,200, 3,544,545 and 3,482,972. The dye developer is diffusible under an alkaline condition but becomes non-diffusible upon a reaction with silver halide.

(2) A non-diffusible compound which releases a diffusible dye under an alkaline condition but loses its function upon a reaction with silver halide as described, for example, in U.S. Pat. No. 4,503,137. Specific examples thereof include a compound which undergoes an intramolecular nucleophilic displacement reaction to release a diffusible dye as described, for example, in U.S. Pat. No. 3,980,479, and a compound which undergoes an intramolecular rewind reaction of an isoxazolone ring to release a diffusible dye as described, for example, in U.S. Pat. No. 4,199,354.

(3) A compound which is reductive to silver halide or an organic silver salt and undergoes the reduction thereof to release a diffusible dye (DRR compound). Such a type of compound is preferred since the compound needs no other reducing agent and thus does not cause any problem of stain of images due to an oxidation decomposition product of the reducing agent. Typical examples of such compounds are described, for example, in U.S. Pat. Nos. 3,928,312, 4,503,312, 4,055,428 and 4,336,322, JP-A-59-65839, JP-A-59-69839, JP-A-53-3819, JP-A-51-104343, *Research Disclosure,* No. 17465, U.S. Pat. Nos. 3,725,062, 3,728,113 and 3,443,939, JP-A-58-116537, JP-A-57-179840, JP-A-8-62805 ad U.S. Pat. No. 4,500,626.

Specific examples of DRR compound include compounds as described in U.S. Pat. No. 4,500,626 (22nd column to 44th column). Particularly preferred among these compounds are Compounds (1) to (3), (10) to (13), (15) to (19), (28) to (30), (33) to (35), (38) to (40), and (42) to (64) described in the above described U.S. Patent. Other useful examples are compounds. described in U.S. Pat. No. 4,639, 408 (37th column to 39th column).

In the present invention, the dye providing compound is particularly preferably a DRR compound.

The dye providing compounds can be incorporated into layers of the light-sensitive material by a known method as described, for example, in U.S. Pat. No. 2,322,027. In such a case, an organic solvent having a high boiling point as described, for example, in JP-A-59-83154, JP-A-59-178451, JP-A-59-178452, JP-A-59-178453, JP-A-59-178454, JP-A-59-178455 and JP-A-59-178457 may be used optionally in combination with a low boiling organic solvent having a boiling point of 50 to 160° C.

The amount of such a high boiling organic solvent to be used is ordinarily 10 g or less, preferably 5 g or less, per g of dye providing compound, and it is ordinarily 1 ml or less, preferably 0.5 ml or less, particularly preferably 0.3 ml or less, per g of binder.

A dispersing method using a polymer as described in JP-B-51-39853 and JP-A-51-59943.

If the additive is a compound which is substantially water-insoluble, it may be incorporated into the binder in the form of fine particles, in addition to the above-described methods.

When the dye providing compound is dispersed in a hydrophilic colloid, various surface active agents can be used. Examples of such surface active agents which can be used include those described as surface active agents in JP-A-59-157636, pages 37 and 38.

A layer to which the dye providing compound is added is not particularly restricted, but the dye providing compound is preferably added to a light-sensitive emulsion layer or an under layer thereof.

The amount of the dye providing compound to be added is suitably from 0.01 mmol/$m^2$ to 5 mmol/$m^2$, preferably from 0.1 mmol/$m^2$ to 1 mmol/$m^2$.

Now, the compound represented by the formula (1) or (2) will be described in greater detail below.

The compounds represented by the formula (1) or (2) include reducing agents (developing agents) which are generically named sulfonamidophenols.

In the formula (1) or (2), $R^5$ preferably represents an aryl group represented by the following formula (3):

(3)

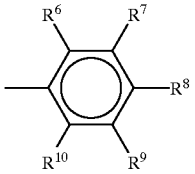

wherein $R^6$, $R^7$, $R^8$, $R^9$ and $R^{10}$, which may be the same or different, each represents a hydrogen atom, a halogen atom, a cyano group, a nitro group or an alkyl, heterocyclic, alkoxy, aryloxy, alkylthio, arylthio, alkylcarbonyl, arylcarbonyl, alkylsulfonyl, arylsulfonyl, alkylcarbonamido, arylcarbonamido, alkylsulfonamido, arylsulfonamido, alkylcarbonyloxy, arylcarbonyloxy, carbamoyl, alkylcarbamoyl, arylcarbamoyl, alkoxycarbonyl, aryloxycarbonyl, sulfamoyl, alkylsulfamoyl, arylsulfamoyl, ureido or urethane group having not more than 4 carbon atoms or an I/O value of not less than 1, or $R^6$ and $R^7$, $R^7$ and $R^8$, $R^8$ and $R^9$ or $R^9$ and $R^{10}$ may be combined each other to form a ring.

The term "I/O value" as used in the substituent having an I/O value of not less than 1 represented by $R^1$ to $R^4$ or $R^6$ to $R^{10}$ means a parameter indicating a scale of hydrophilicity/oleophilicity of a compound or a substituent. The I/O value is described in detail in Yoshio Koda, *Yuuki Gainenzu,* Sankyo Shuppan published on May 10, 1984. In the I/O value, I represents inorganic property and O represents organic property. The larger the I/O value, the higher the inorganic property. Specific example of the I/O value is described below. The I values of a typical group of —NHCO—, —$NHSO_2$— and —COO— are 200, 240 and 60, respectively. For instance, with respect to a group of —$NHCOC_5H_{11}$, the O value is 200×6=120 because the number of carbon atoms is 6. On the other hand, since the I value of the group is 200, the I/O value is about 1.67 which is not less than 1.

Of the compounds represented by the formula (1) or (2), those having a halogen atom, a cyano group or a substituent having an I/O value of not less than 1 or having not more than 4 carbon atoms, at the position of at least one of $R^1$ to $R^4$ and/or at least one of $R^6$ to $R^{10}$ are preferred.

Specific examples of $R^1$ to $R^4$ or $R^6$ to $R^{10}$ include a hydrogen atom, a halogen atom (e.g., chlorine or bromine), a cyano group, a nitro group (only for $R^6$ to $R^{10}$), an alkyl group (e.g., methyl, ethyl, isopropyl, n-butyl or tert-butyl), an aryl group (e.g., 3-methanesulfonylaminophenyl), a heterocyclic group (e.g., 2-imidazolyl), an alkoxy group (e.g., methoxy or ethoxy), an aryloxy group (e.g., 4-methanesulfonylaminophenoxy), an alkylthio group (e.g., methlythio, ethylthio or butylthio), an arylthio group (e.g., 4-methanesulfonylaminophenylthio), an alkylcarbonyl group (e.g., acetyl, propionyl or butyloyl) an arylcarbonyl group (e.g., benzoyl or alkylbenzoyl), an alkylsulfonyl group (methanesulfonyl or ethanesulfonyl), an arylsulfonyl group (e.g., phenylsulfonyl, 4-chlorophenylsulfonyl or p-toluenesulfonyl), an alkylcarbonamido group (e.g., acetylamino, propinylamino or butyloylamino), an arylcarbonamido group (e.g., benzoylamino group), an alkylslfonamido group (e.g., methanesulfonylamino or ethanesulfonylamino), an arylsulfonamido group (e.g., benzenesulfonylamino or toluenesulfonylamino), an alkylcarbonyloxy group (e.g., methylcarbonyloxy, propylcarbonyloxy or butylcarbonyloxy), an arylcarbonyloxy group (e.g., 4-methanesulfonylaminobenzoyloxy), a carbamoyl group, an alkylcarbamoyl group (e.g., methylcarbamoyl, dimethylcarbamoyl, ethylcarbamoyl, diethylcarbamoyl dibutylcarbamoyl, piperidinocarbamoyl, or morpholinocarbamoyl), an arylcarbamoyl group (e.g., phenylcarbamoyl, methylphenylcarbamoyl, ethylphenylcarbamoyl or benzylphenylcarbamoyl), an alkoxycarbonyl group (e.g., methoxycarbonyl, ethoxycarbonyl or butoxycarbonyl), an aryloxycarbonyl group (e.g., phenoxycarbonyl), a sulfamoyl group, an alkylsulfamoyl group (e.g., methylsulfamoyl, dimethylsulfamoyl, ethylsulfamoyl, diethylsulfamoyl, dibutylsulfamoyl, piperidinosulfamoyl or morpholinosulfamoyl), an arylsulfamoyl group (e.g., phenylsulfamoyl, methylpheylsulfamoyl ethylphenylsulfamoyl or benzylsulfamoyl), a ureido group (e.g., methylaminocarbonamido or anilinocarbonamido) or a urethane group (e.g., methoxycarbonamido or anilinocarbonamido).

Particularly, compounds represented by the formula (1) wherein $R^2$ and/or $R^4$ and $R^6$ and/or $R^{10}$ each represents a substituent other than a hydrogen atom, and compounds represented by the formula (2) wherein $R^4$ and $R^6$ and/or $R^{10}$ each represents a substituent other than a hydrogen atom are preferred. Also, when $R^1$ and $R^2$, $R^3$ and $R^4$, $R^6$ and $R^7$, $R^7$ and $R^8$, $R^8$ and $R^9$ or $R^9$ and $R^{10}$ are substituents other than hydrogen atoms, they may be combined each other to form a ring as far as the I/O value of the combination of respective groups is not less than 1.

The compounds represented by the formula (1) are more preferred in view of the effect of the present invention.

The compounds represented by the formula (1) or (2) can be synthesized by stepwise combining methods well known in the field of organic synthetic chemistry. One example of the synthesis is shown specifically below according to synthetic scheme:

Synthetic Route of Compound

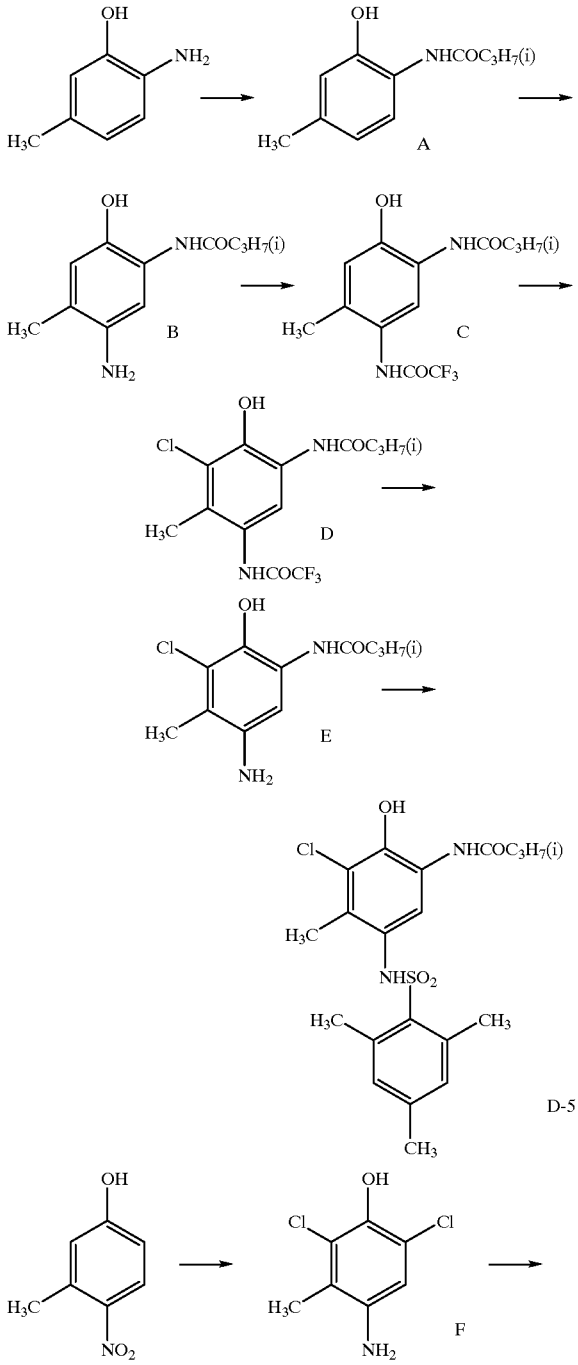

-continued

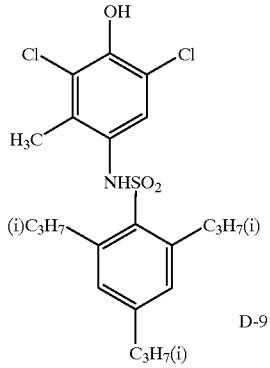

D-9

Specific examples of the compounds represented by the formula (1) or (2) are set forth below, but the present invention should not be construed as being limited thereto.

(D-1)

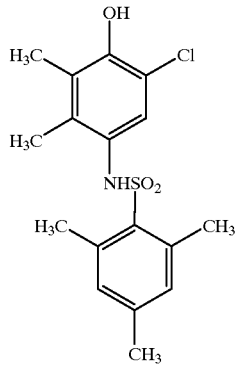

(D-2)

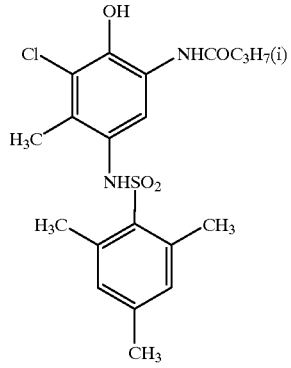

(D-3)

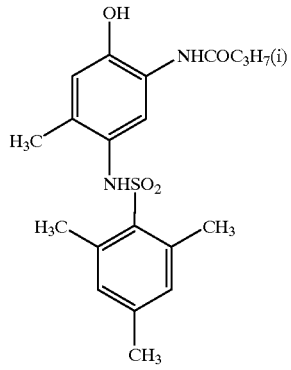

-continued
(D-4)
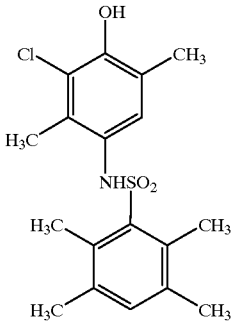
(D-5)
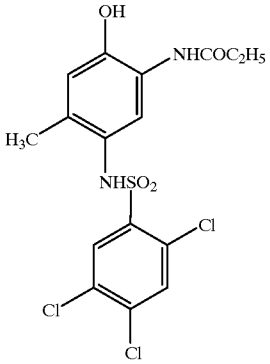
(D-6)
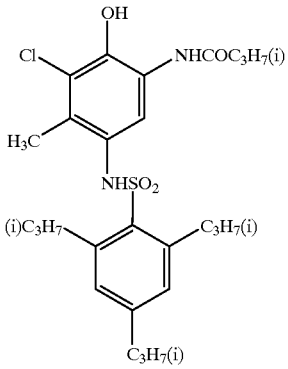
(D-7)
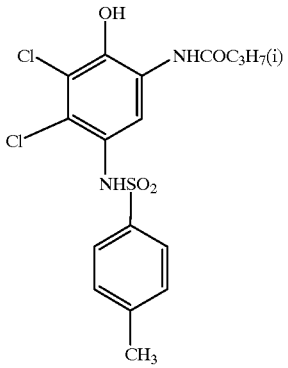
-continued
(D-8)
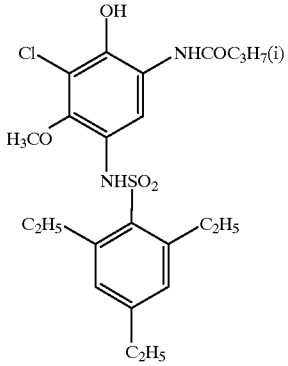
(D-9)
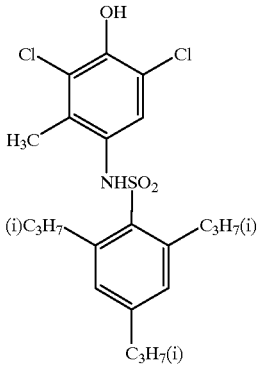
(D-10)
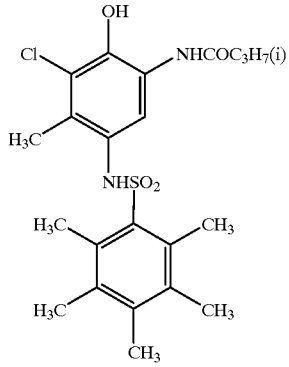
(D-11)
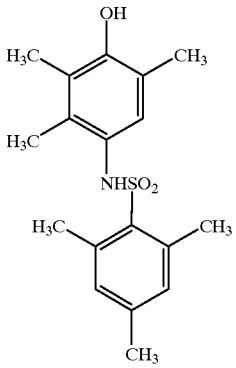

-continued
(D-12)
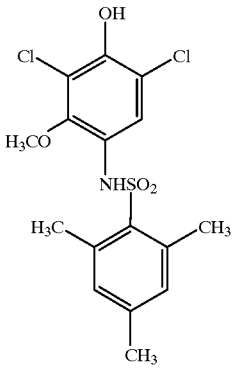
(D-13)
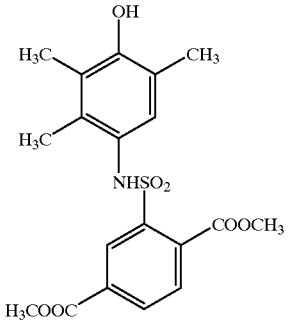
(D-14)
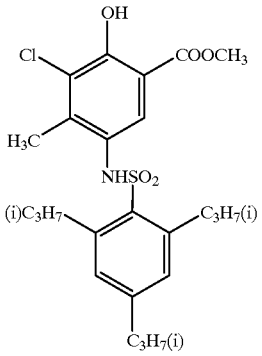
(D-15)
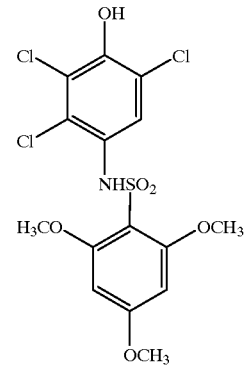
-continued
(D-16)
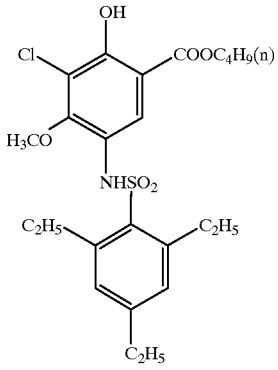
(D-21)
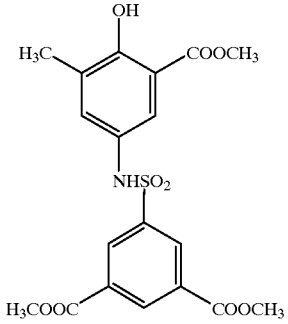
(D-22)
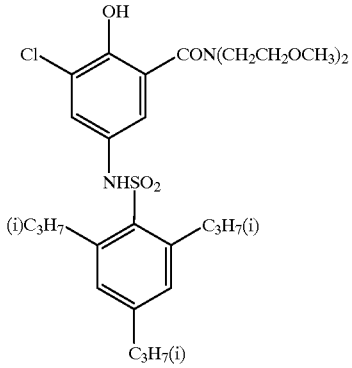
(D-23)
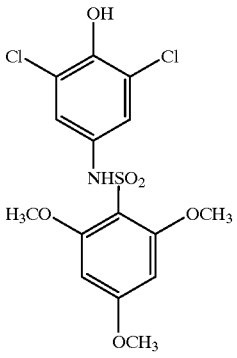

-continued (D-24)

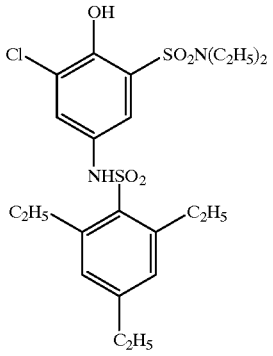

The amount of the compound represented by the formula (1) or (2) used according to the present invention is preferably from 0.01% by mole to 2% by mole, more preferably from 0.05% by mole to 1% by mole, and yet more preferably from 0.05% by mole to 0.5% by mole, based on the dye providing compound represented by the formula (L1).

The compounds represented by the formula (1) or (2) according to the present invention can be incorporated into any layer, for example, a light-sensitive emulsion layer, a light-insensitive emulsion layer or a light-insensitive layer.

The compound represented by the formula (1) or (2) according to the present invention can be incorporated into a layer of the heat developable light-sensitive material by a known method as described, for example, in U.S. Pat. No. 2,322,027. In such a case, a organic solvent having a high boiling point as described, for example, in U.S. Pat. Nos. 4,555,470, 4,536,466, 4,536,467, 4,587,206, 4,555,476 and 4,599,296 and JP-B-3-62256 can be used optionally in combination with a low boiling organic solvent having a boiling point of from 50° C. to 160° C.

The amount of such a high boiling organic solvent is ordinarily 50 g or less, preferably 10 g or less, per gram of the compound represented by the formula (1) or (2) to be used. Further, it is ordinarily 1 ml or less, preferably 0.5 ml or less, and more preferably 0.3 ml or less, per gram of binder.

A dispersing method using a polymer as described in JP-B-51-39853 and JP-A-51-59943, and a method of addition as a fine particle dispersion as described in JP-A-62-30242 can also be employed.

When the compound represented by the formula (1) or (2) is dispersed in a hydrophilic colloid, various surface active agents can be used. For example, surface active agents as described in JP-A-59-157636, pages 37 and 38 can be utilized. The same can be applied to dispersing hydrophobic compounds other than those represented by the formula (1) or (2).

Now, techniques which are preferably employed in the present invention will be described below.

The heat developable color photographic light-sensitive material of the present invention fundamentally comprises a light-sensitive silver halide emulsion, the dye providing compound represented by the formula (L1), the compound represented by the formula (1) or (2) and a binder on a support, and if desired, an organic metal salt oxidizing agent may be further contained.

These components are added to the same layer in many cases, however, these components may be dividedly added to separate layers. For example, when a colored dye providing compound is present in a lower layer of the silver halide emulsion, reduction in sensitivity can be prevented.

In order to obtain colors over a wide range within the chromaticity diagram using three primary colors of yellow, magenta and cyan, at least three silver halide emulsion layers having sensitivity in different spectral regions are used in combination. For example, a layer combination of a blue-sensitive layer, a green-sensitive layer and a red-sensitive layer, a layer combination of a green-sensitive layer, a red-sensitive layer and an infrared-sensitive layer, and a layer combination of a red-sensitive layer, an infrared-sensitive layer (1) and an infrared-sensitive layer (2) as described, for example, in JP-A-59-180550, JP-A-64-13546, JP-A-62-253159 and EP-A-479,167 may be used. Respective light-sensitive layers may be arranged in any order and various arrangement orders known for conventional type color light-sensitive materials may be used. Further, each of these light-sensitive layers may be divided into two or more layers, if desired, as described, for example, in JP-A-1-252954.

The heat developable light-sensitive material may have various light-insensitive layers such as a protective layer, a subbing layer, an interlayer, a yellow filter layer, an antihalation layer and a back layer between the silver halide emulsion layers described above or as the uppermost layer or lowermost layer.

Specific examples thereof include a subbing layer as described in U.S. Pat. No. 5,051,335, an interlayer having a solid pigment as described in JP-A-1-167838 and JP-A-61-20943, an interlayer having a reducing agent or a DIR compound as described in JP-A-1-120553, JP-A-5-34884 and JP-A-2-64634, an interlayer having an electron transfer agent as described in U.S. Pat. Nos. 5,017,454 and 5,139,919 and JP-A-2-235044, a protective layer having a reducing agent as described in JP-A-4-249245, and a layer comprising a combination of these layers.

The support is preferably designed to have an antistatic function and a surface resistivity of $10^{12}$ Ω·cm or less.

Now, a silver halide emulsion for use in the heat developable color light-sensitive material of the present invention will be described in detail below.

The silver halide emulsion which can be used in the present invention may be any of silver chloride, silver bromide, silver iodobromide, silver chlorobromide, silver chloroiodide and silver chloroiodobromide.

The silver halide emulsion for use in the present invention may be either a surface latent image type emulsion or an internal latent image type emulsion. The internal latent image type emulsion is used as a direct reversal emulsion in combination with a nucleating agent or light fogging. Further, it may be a so-called core/shell emulsion in which the inside of grain different from the surface thereof in the phase, and silver halides different in composition may be joined by epitaxial junction. The silver halide emulsion may be either a monodisperse emulsion or polydisperse emulsion, and a method is preferably used in which monodisperse emulsions are mixed to adjust gradation as described in JP-A-1-167743 and JP-A-4-223463. The grain size is preferably 0.1 μm to 2 μm, and more preferably 0.2 μm to 1.5 μm.

Crystal habit of the silver halide grains may be any of a regular crystal form such as a cubic, an octahedral or a tetradecahedral form, an irregular crystal form such as a spherical form or a tabular form having a high aspect ratio, a form having a crystal defect such as a twin plane, and a combined form thereof.

Specifically, any of silver halide emulsions can be used which are prepared by methods described in U.S. Pat. No. 4,500,626, column 50, U.S. Pat. No. 4,628,021, *Research*

*Disclosure* (hereinafter abbreviated as "RD"), No. 17029 (1978), ibid., No. 17643, pages 22 and 23 (December, 1978), ibid., No. 18716, page 648 (November, 1979), ibid., No. 307105, pages 863–865 (November, 1989), JP-A-62-253159, JP-A-64-13546, JP-A-2-236546, JP-A-3-110555, P. Glafkides, *Chemie et Phisique Photographigue* (Paul Montel, 1967), G. F. Duffin, *Photographic Emulsion Chemistry* (Focal Press, 1966) and V. L. Zelikman et al., *Making and Coating Photographic Emulsion* (Focal Press, 1964).

In the course of preparation of the light-sensitive silver halide emulsion of the present invention, a so-called desalting for removing excess salts is preferably conducted. As means for this, water washing with noodle may be used which is conducted by gelation of gelatin, and a precipitation method may also be used utilizing poly-valent anionic inorganic salts (for example, sodium sulfate), anionic surface active agents, anionic polymers (for example, polysodium styrenesulfonate) or gelatin derivatives (for example, aliphatic acylated gelatin, aromatic acylated gelatin and aromatic carbamoylated gelatin). The precipitation method is preferably used.

For various purposes, the light-sensitive silver halide emulsion used in the present invention may contain a compound of a heavy metal such as iridium, rhodium, platinum, cadmium, zinc, thallium, lead, iron and osmium. These compounds may be used individually or as a combination of two or more thereof. The amount added is generally about $10^{-9}$ to $10^{-3}$ mol per mol of silver halide, although it depends on the purpose of use. They may be uniformly added to grains or localized in the insides or surfaces of grains. Specifically, emulsions described, for example, in JP-A-2-236542, JP-A-1-116637 and JP-A-5-181246 are preferably used.

In the grain forming stage of the light-sensitive silver halide emulsion of the present invention, a rhodanide ammonia, a 4-substituted thioether compound, an organic thioether derivative described in JP-B-47-11386 or a sulfur-containing compound described in JP-A-53-144319 can be used as a solvent for silver halide.

For other conditions, reference can be made to the descriptions of P. Glafkides, *Chemie et Phisigue Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964) which are described above. Specifically, any of an acid process, a neutral process and an ammonia process may be used. A soluble silver salt and a soluble halogen salt may be reacted with each other by using any of a single jet process, a double jet process and a combination thereof. In order to obtain a monodispersed emulsion, the double jet process is preferably used.

A reverse mixing process in which grains are formed in the presence of excess silver ions can also be used. As one type of double jet process, a process of maintaining the pAg in a liquid phase constant in which a silver halide is formed, namely a so-called controlled double jet process, can also be used.

In order to accelerate growth of grains, the concentration, the amount and the rate of addition of a silver salt and a halogen salt may be increased (JP-A-55-142329, JP-A-55-158124 and U.S. Pat. No. 3,650,757).

A reaction solution may be stirred by any of known stirring methods. The temperature and the pH of the reaction solution during formation of silver halide grains may be appropriately established depending on the purpose. The pH range is preferably from 2.3 to 8.5, and more preferably from 2.5 to 7.5.

The light-sensitive silver halide emulsion is usually chemically sensitized. For chemical sensitization of the light-sensitive silver halide emulsion of the present invention, chalcogen sensitization such as sulfur sensitization, selenium sensitization or tellurium sensitization, noble metal sensitization using gold, platinum, palladium, etc. and reduction sensitization can be used alone or in combination (for example, JP-A-3-110555 and JP-A-5-241267). Such chemical sensitization can also be conducted in the presence of a nitrogen-containing heterocyclic compound (JP-A-62-253159). Further, an antifoggant described below can be added after chemical sensitization. Specifically, methods described in JP-A-5-45833 and JP-A-62-40446 can be used.

The pH on chemical sensitization is preferably from 5.3 to 10.5, and more preferably from 5.5 to 8.5, and the pAg is preferably from 6.0 to 10.5, and more preferably from 6.8 to 9.0.

The coated amount of the light-sensitive silver halide emulsion for use in the present invention is preferably from 1 mg/m$^2$ to 10 g/m$^2$, more preferably from 10 mg/m$^2$ to 10 g/m$^2$, in terms of silver.

In order to provide color sensitivities of green, red and infrared to the light-sensitive silver halide emulsion for use in the present invention, the light-sensitive silver halide emulsion is ordinarily spectrally sensitized with a methine dye or the like. Further, spectral sensitization of blue region may be applied to a blue-sensitive emulsion, if desired.

The dyes used include cyanine dyes, merocyanine dyes, complex cyanine dyes, complex merocyanine dyes, holopolarcyanine dyes, hemicyanine dyes, styryl dyes and hemioxanol dyes.

Specifically, they include sensitizing dyes described, for example, in U.S. Pat. No. 4,617,257, JP-A-59-180550, JP-A-64-13546, JP-A-5-45828 and JP-A-5-45834.

These sensitizing dyes may be used alone or in combination. The combination of the sensitizing dyes is often used, particularly for supersensitization and wavelength adjustment of spectral sensitivity.

The emulsion may contain a dye having no spectral sensitization effect itself or a compound which does not substantially absorb visible light and exhibits supersensitization, in combination with the sensitizing dye (for example, those described, for example, in U.S. Pat. No. 3,615,641 and JP-A-63-23145).

The sensitizing dye may be added to the emulsion before, during or after chemical ripening or before or after nucleation of silver halide grains as described in U.S. Pat. Nos. 4,183,756 and 4,225,666. The sensitizing dye and supersensitizer may be added as a solution in an organic solvent such as methanol, a dispersion in gelatin or a solution in a surface active agent. The sensitizing agent is ordinarily added in an amount of from about $10^{-8}$ mol to about $10^{-2}$ mol per mol of silver halide.

Additives for use in such processes and known photographic additives which can be used in the heat developable color light-sensitive material and the dye fixing element of the present invention are described in *RD,* No. 17643, ibid., No. 18716 and ibid., No. 307105 described above and corresponding portions thereof are summarized in the following table.

| Type of Additives | RD17643 | RD18716 | RD307105 |
|---|---|---|---|
| 1. Chemical Sensitizers | p. 23 | p. 648, right column | p. 866 |
| 2. Sensitivity Increasing Agents | | p. 648, right column | |
| 3. Spectral Sensitizers, Supersensitizers | pp. 23–24 | p. 648, right column to p. 649, right column | pp. 866–868 |
| 4. Fluorescent, Brightening Agents | p. 24 | p. 648, right column | p. 868 |
| 5. Antifoggants, Stabilizers | pp. 24–25 | p. 649, right column | pp. 868–870 |
| 6. Light Absorbers, Filter Dyes, UV Absorbers | pp. 25–26 | p. 649, right column to p. 650, left column | p. 873 |
| 7. Dye Image Stabilizers | p. 25 | p. 650, left column | p. 872 |
| 8. Hardeners | p. 26 | p. 651, left column | pp. 874–875 |
| 9. Binders | p. 26 | p. 651, left column | pp. 873–874 |
| 10. Plasticizers, Lubricants | p. 27 | p. 650, right column | p. 876 |
| 11. Coating Aids, Surfactants | pp. 26–27 | p. 650 right column | pp. 875–876 |
| 12. Antistatic Agents | p. 27 | p. 650 right column | pp. 876–877 |
| 13. Matte Agents | | | pp. 878–879 |

As the binder for the layers constituting the heat developable color light-sensitive material and the dye fixing element, a hydrophilic binder is preferably used. Examples thereof include the binders described in Research Disclosures described above and JP-A-64-13546, pages 71 to 75. Specifically, a transparent or translucent hydrophilic binder is preferred, and examples thereof include a natural compound such as protein (for example, gelatin and a gelatin derivative) and a polysaccharide (for example, a cellulose derivative, starch, gum arabic, dextran and pullulan), and a synthetic polymer such as polyvinyl alcohol, polyvinylpyrrolidone and polyacrylamide. Further, examples of the binder which can be used also include a highly water-absorptive polymer as described, for example, in U.S. Pat. No. 4,960,681 and JP-A-62-245260, specifically, a homopolymer of vinyl monomer having —COOM or —$SO_3$M (wherein M represents a hydrogen atom or an alkali metal), or a copolymer of the vinyl monomers with each other or with other monomer (for example, sodium methacrylate, ammonium methacrylate and Sumikagel L-5H manufactured by Sumitomo Chemical Co., Ltd.). The binders can be used as a combination of two or more thereof. In particular, a combination of gelatin and the above-mentioned binder is preferred. Gelatin is selected from lime-treated gelatin, acid-treated gelatin, so-called delimed gelatin reduced in a content of calcium and the like, depending on various purposes, and they are also preferably used in combination.

When the system of supplying a trace amount of water to conduct heat development is employed, use of the above-mentioned highly water-absorptive polymer makes it possible to rapidly absorb water. When the highly water-absorptive polymer is used in the dye fixing layer or the protective layer therefor permits prevention of retransfer of the dye from the dye fixing element to the others after transfer.

In the present invention, the amount of binder coated is preferably from 0.2 g/$m^2$ to 20 g/$m^2$, more preferably from 0.2 g/$m^2$ to 10 g/$m^2$, and yet more preferably from 0.5 g/$m^2$ to 7 g/$m^2$.

In the present invention, an organic metal salt can also be used as an oxidizing agent in combination with the light-sensitive silver halide emulsion. Of these organic metal salts, an organic silver salt is particularly preferably used.

An organic compound which can be used for formation of the above-described organic silver salt oxidizing agent includes a benzotriazole compound, a fatty acid and other compounds as described, for example, in U.S. Pat. No. 4,500,626, columns 52 and 53. Silver acetylide described in U.S. Pat. No. 4,775,613 is also useful. The organic silver salts may be used as a combination of two or more thereof.

The organic silver salt described above can be used in combination with the light-sensitive silver halide in an amount of from 0.01 mol to 10 mol, preferably from 0.01 mol to 1 mol, per mol of light-sensitive silver halide. The coated amount of light-sensitive silver halide emulsion is ordinarily from 0.05 g/$m^2$ to 10 g/$m^2$, preferably from 0.1 g/$m^2$ to 4 g/$m^2$, in terms of silver.

In the present invention, a reducing agent known in the field of heat developable color light-sensitive material can be used. Further, the reducing agent also includes a reductive dye providing compound described below (in this case, it can also be used in combination with other reducing agent). Furthermore, a precursor of reducing agent can also be used which itself has no reductive ability, but exhibits reductive ability by action of a nucleophilic reagent or heat during the course of development.

Examples of the reducing agent for use in the present invention include reducing agents and precursors of reducing agents described, for example, in U.S. Pat. No. 4,500,626, columns 49 and 50, U.S. Pat. Nos. 4,839,272, 4,330,617, 4,590,152, 5,017,454 and 5,139,919, JP-A-60-140335, pages 17 and 18, JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62-131253, JP-A-62-131256, JP-A-63-10151, JP-A-64-13546, pages 40 to 57, JP-A-1-120553, JP-A-2-32338, JP-A-2-35451, JP-A-2-234158, JP-A-3-160443 and EP-A-220,746, pages 78 to 96.

Combinations of various reducing agents as disclosed in U.S. Pat. No. 3,039,869 can also be used.

Furthermore, for various purposes such as color mixing prevention, improvement in color reproduction, improvement in white ground and prevention of silver transfer to a dye fixing element, the above-described reducing agent can be used in an intermediate layer or a protective layer. Specifically, reducing agents described in EP-A-524,649, EP-A-357,040, JP-A-4-249245, JP-A-2-64633, JP-A-2-46450 and JP-A-63-186240 are preferably used. Reductive compounds releasing development inhibitors as described in JP-B-3-63733, JP-A-1-150135, JP-A-2-110557, JP-A-2-64634, JP-A-3-43735 and EP-A-451,833 are also used. Further, addition of hydroquinone to a protective layer as described in JP-A-5-127335 is preferably employed.

In the present invention, the amount of the reducing agent added is preferably from 0.001 mol to 20 mol, and more preferably from 0.01 mol to 10 mol, per mol of silver.

A hydrophobic additive such as the dye providing compound or the diffusion-resistant reducing agent can be incorporated into a layer of the heat developable light-sensitive material by a known method as described, for example, in U.S. Pat. No. 2,322,027. In such a case, an organic solvent having a high boiling point as described, for example, in U.S. Pat. Nos. 4,555,470, 4,536,466, 4,536,467, 4,587,206, 4,555,476 and 4,599,296 and JP-B-3-62256 can be used optionally in combination with a low boiling organic solvent having a boiling point of 50° C. to 160° C. The dye providing compounds, diffusion-resistant reducing agents and high boiling organic solvents can be used as a combination of two or more thereof.

The amount of the high boiling organic solvent is ordinarily 10 g or less, preferably 5 g or less, and more preferably from 0.1 g to 1 g, per gram of the dye providing compound to be used. Further, it is 1 ml or less, preferably 0.5 ml or less, and more preferably 0.3 ml or less, per gram of binder.

A dispersing method using a polymer as described in JP-B-51-39853 and JP-A-51-59943, and a method of addition as a fine particle dispersion as described in JP-A-62-30242 can also be used.

If the additive is a compound which is substantially insoluble in water, it may be dispersed in the binder as fine particles, in addition to the above-described methods.

When the hydrophobic compound is dispersed in a hydrophilic colloid, various surface active agents can be used. For example, surface active agents as described in JP-A-59-157636, pages 37 and 38 and Research Disclosures described above can be used.

A compound for activating development and simultaneously stabilizing images can be used in the heat developable color light-sensitive material of the present invention. Preferred examples of such compound are described in U.S. Pat. No. 4,500,626, columns 51 and 52.

In the process for forming images by diffusion transfer of dyes, various compounds can be added to the layers constituting the heat developable color light-sensitive material of the present invention for fixing or decoloring unnecessary dyes or colored products to improve white ground of the images obtained.

Specifically, compounds described in EP-A-353,741, EP-A-461,416, JP-A-63-163345 and JP-A-62-203158 can be used.

Various pigments and dyes can be used in the layers constituting the heat developable color light-sensitive material of the present invention for improving color separation and increasing sensitivity.

Specifically, compounds described in Research Disclosures stated above, and compounds and layer constitution described, for example, in EP-A-479,167, EP-A-502,508, JP-A-1-167838, JP-A-4-343355, JP-A-2-168252, JP-A-61-20943, EP-A-479,167 and EP-A-502,508 can be used.

In the process for forming images by diffusion transfer of dyes, a dye fixing element is used together with the heat developable color light-sensitive material. The dye fixing element is separately provided on a support different from that for the light-sensitive material, or provided on the support for the light-sensitive material. For the mutual relations between the light-sensitive material and the dye fixing element, the relation to support and the relation to a white ground reflection layer, the relations described in U.S. Pat. No. 4,500,626, column 57 can also be applied to the present invention.

The dye fixing element preferably used in the present invention has at least one layer containing a mordant and a binder. As the mordants, those known in the field of photography can be used. Examples thereof include mordants described in U.S. Pat. No. 4,500,626, columns 58 and 59, JP-A-61-88256, pages 32 to 41, JP-A-1-161236, pages 4 to 7, U.S. Pat. Nos. 4,774,162, 4,619,883 and 4,594,308. Dye receiving polymer compounds as described in U.S. Pat. No. 4,463,079 may also be used.

In the dye fixing element for use in the present invention, the above-described hydrophilic binder is preferably used. Further, a carrageenan compound as described in EP-A-443,529 and a latex having a glass transition temperature of 40° C. or less as described in JP-B-3-74820 are preferably used in combination.

The dye fixing element can be provided with a supplemental layer such as a protective layer, a stripping layer, an undercoat layer, an intermediate layer, a back layer and an anti-curling layer, if desired. In particular, it is useful to provide the dye fixing element with a protective layer.

In the layers constituting the heat developable color light-sensitive material and the dye fixing element, a high boiling organic solvent can be used as a plasticizer, a slipping agent or a separation-improving agent of the light-sensitive material from the dye fixing element. Examples thereof include solvents described, for example, in Research Disclosures described above and JP-A-62-245253.

Further, various silicone oils (all silicone oils including dimethylsilicone oils and modified silicone oils in which various organic groups are introduced into dimethylsiloxanes) can be used for the above-described purposes. Suitable examples thereof include various modified silicone oils described in *Modified Silicone Oils,* Technical Data P6-18B, published by Shin-Etsu Silicone Co., Ltd., particularly carboxy-modified silicone (trade name: X-22-3710).

Furthermore, silicone oils described in JP-A-62-215953 and JP-A-63-46449 are also effective.

A fluorescent brightening agent may be used in the heat developable color light-sensitive material and the dye fixing element. In particular, it is preferred that the fluorescent brightening agent is incorporated into the dye fixing element or supplied from the outside such as the heat developable light-sensitive material or a transfer solvent. Examples thereof include compounds described, for example, in *The Chemistry of Synthetic Dyes,* edited by K. Veenkataraman, vol. V, chapter 8 and JP-A-61-143752. More specifically, they include stilbene compounds, coumarin compounds, biphenyl compounds, benzoxazolyl compounds, naphthalimide compounds, pyrazoline compounds and carbostyryl compounds.

The fluorescent brightening agent can be used in combination with a color-fading preventing agent or an ultraviolet absorber.

Specific examples of the color-fading preventing agents, ultraviolet absorbers and fluorescent brightening agents are described in JP-A-62-215272, pages 125 to 137, and JP-A-1-161236, pages 17 to 43.

A hardener for use in layers constituting the heat developable color light-sensitive material and the dye fixing element includes hardeners described in Research Disclosures described above, U.S. Pat. No. 4,678,739, column 41 and U.S. Pat. No. 4,791,042, JP-A-59-116655, JP-A-62-245261, JP-A-61-18942 and JP-A-4-218044. More specifically, examples thereof include aldehyde hardeners (such as formaldehyde), aziridine hardeners, epoxy hardeners, vinylsulfone hardeners (such as N,N'-ethylenebis (vinylsulfonyl-acetamido)ethane), N-methylol hardeners (dimethylolurea) and polymer hardeners (compounds described, for example, in JP-A-62-234157).

The hardener is used in an amount of 0.001 g to 1 g, preferably 0.005 g to 0.5 g, per g of gelatin coated, and may be added to any of the layers constituting the light-sensitive material and the dye fixing element. Further, it may be divided and added to two or more layers.

In the layers constituting the heat developable color light-sensitive material and the dye fixing element, various antifoggants, photographic stabilizers and precursors thereof can be used. Specific examples thereof include azoles and azaindenes described in RD, 17643 (1978), pages 24 to 25, carboxylic acids and phosphoric acids each containing a nitrogen atom described in JP-A-59-168442, mercapto compounds and salts thereof described in JP-A-59-111636, and acetylene compounds described in JP-A-62-87957. When the precursor is employed in the present invention, it is particularly preferred to use in the light-sensitive silver halide emulsion layer. However, it is used in the dye fixing element.

When these compounds are added to the light-sensitive silver halide emulsion layer, the addition amount is preferably from $5\times10^{-6}$ mol to $1\times10^{-1}$ mol per mol of silver, and more preferably from $1\times10^{-5}$ mol to $1\times10^{-2}$ mol per mol of silver. In the case where these compounds are added to the dye fixing element, they can be used in an amount from $5\times10^{-6}$ mol to 1 mol per mol of silver in the light-sensitive material that is used in combination.

In the layers constituting the heat developable color light-sensitive material and the dye fixing element, various surfactants can be used for the purpose of assisting coating, improving stripping, improving slipping, preventing electric charge and accelerating development. Examples of the surfactants are described, for example, in Research Disclosures described above, JP-A-62-173463 and JP-A-62-183457.

The layers constituting the heat developable color light-sensitive material and the dye fixing element may contain an organic fluoro compound for improving slipping, preventing electric charge and improving stripping. Typical examples of the organic fluoro compounds include fluorine surfactants described, for example, in JP-B-57-9053, columns 8 to 17, JP-A-61-20944 and JP-A-62-135826, and hydrophobic fluorine compounds such as oily fluorine compounds (for example, fluorine oil) and solid fluorine compounds (for example, an ethylene tetrafluoride resin).

In the heat developable color light-sensitive material and the dye fixing element, a matting agent can be used for preventing adhesion and improving slipping. The matting agents include compounds such as benzoguanamine resin beads, polycarbonate resin beads and AS resin beads as described in JP-A-63-274944 and JP-A-63-274952, as well as compounds such as silicon dioxide, polyolefins and polymethacrylates described in JP-A-61-88256, page 29. In addition, compounds described in Research Disclosures described above can be used. The matting agent may be added not only to the uppermost layer (protective layer) but also to under layer(s), if desired.

In addition, the layers constituting the heat developable color light-sensitive material and the dye fixing element may contain a heat solvent, a defoaming agent, a sterilizer, an antifungal agent and colloidal silica. Examples of these additives are described, for example, in JP-A-61-88256, pages 26 to 32, JP-A-3-11338 and JP-B-2-51496.

In the present invention, an image formation accelerating agent can be used in the heat developable color light-sensitive material and/or the dye fixing element. The image formation accelerating agent has functions such as acceleration of a redox reaction of the silver salt oxidizing agent and the reducing agent, acceleration of a reaction such as the formation of a dye from the dye providing compound, the degradation of dye or the release of a diffusible dye and acceleration of movement of dye from the heat developable light-sensitive material to the dye fixing element, and can be classified into a base or base precursor, a nucleophilic compound, a high boiling organic solvent (oil), a heat solvent, a surfactant, a compound having interaction with silver or silver ion, according to the physicochemical function. However, these groups of substances generally have combined functions, and therefore, they have usually combinations of some of the above-described acceleration effects. The details thereof are described in U.S. Pat. No. 4,678,739, columns 38 to 40.

The base precursor includes a salt of organic acid and base which are decarboxylated by heat, and a compound releasing an amine by the intermolecular nucleophilic substitution reaction, the Lossen rearrangement or the Beckmann rearrangement. Specific examples thereof are described, for example, in U.S. Pat. Nos. 4,514,493 and 4,657,848.

In a system in which heat development and dye transfer are concurrently performed in the presence of a small amount of water, it is preferred from the view point of the enhancement of preservability of the heat developable light-sensitive material that the base and/or the base precursor are allowed to be contained in the dye fixing element.

In addition, a combination of a hardly soluble metal compound and a compound (referred to as a "complex-formable compound") which can form a complex with the metal ion constituting the hardly soluble metal compound as described in EP-A-210,660 and U.S. Pat. No. 4,740,445, and a compound generating a base by electrolysis as described in JP-A-61-232451 can also be used as the base precursor. In particular, the former is effective. It is advantageous that the hardly soluble metal compound and the complex-formable compound are separately added such that one is incorporated into the heat developable light-sensitive material and the other into the dye fixing element as described in the above-described patents.

In the present invention, in the heat developable color light-sensitive material and/or the dye fixing element, various development stoppers can be used for stably obtaining constant images against fluctuations in processing temperature and processing time on development.

The development stopper as used herein is a compound which, after appropriate development, rapidly neutralizes or reacts with a base to reduce the concentration of the base contained in a film, to thereby stop development, or a compound which interacts with silver and a silver salt to inhibit development. Examples thereof include an acid precursor which releases an acid by heating, an electrophilic compound which conducts a replacement reaction with a coexisting base by heating, a nitrogen-containing heterocyclic compound, a mercapto compound and precursor thereof. More specifically, they are described in JP-A-62-253159, pages 31 and 32.

In the present invention, a support which can endure processing temperature is used as a support of the heat developable color light-sensitive material or the dye fixing element. In general, the support includes supports for photography such as paper and synthetic polymers (films) described in *Shashin Kohgaku no Kiso* (*Gin-en Shashin*) (The Fundamentals of Photographic Engineering (Silver Salt Photograph), pages 223 to 240 (1979), Corona Publishing Co. Ltd. Specifically, the supports used include polyethylene terephthalate, polyethylene naphthalate, polycarbonates, polyvinyl chloride, polystyrene, polypropylene, polyimides, cellulose derivatives (for example, cellulose triacetate), films thereof containing a pigment such as titanium oxide, synthetic paper produced from polypropylene or the like by a film method, mixed paper produced from pulp of a synthetic resin such as polyethylene and natural pulp, Yankee paper, baryta paper, coated paper (particularly, cast-coated paper), a metal, cloth and glass.

They can be used alone or as a support laminated with a synthetic polymer such as polyethylene on one side or both sides. The laminate layers can contain a pigment such as titanium oxide, ultramarine and carbon black, or a dye, if desired.

In addition, supports described in JP-A-62-253159, pages 29 to 31, JP-A-1-161236, pages 14 to 17, JP-A-63-316848, JP-A-2-22651, JP-A-3-56955 and U.S. Pat. No. 5,001,033 can be used.

A back surface of the support may be coated with a hydrophilic binder and a semiconductive metal oxide such as an alumina sol and tin oxide, or with an antistatic agent such as carbon black. Specifically, supports described in JP-A-63-220246 can be used. Preferably, a surface of the support is variously treated or undercoated for improving adhesion to the hydrophilic binder.

A method for exposing the heat developable color light-sensitive material to record an image include, for example, a method of directly taking a landscape photograph or a human subject photograph by use of a camera, a method of exposing the light-sensitive material through a reversal film or negative film by use of a printer or enlarger, a method of subjecting an original to scanning exposure through a slit by use of an exposing device of copying machine, a method of allowing a light emitting diode or various lasers (such as laser diode and gas laser) to emit light by image information through electric signals to subject the light-sensitive material to scanning exposure (as described in JP-A-2-129625, JP-A-5-176114, JP-A-5-199372, JP-A-6-127021), and a method of supplying image information to a image display such as CRT, a liquid crystal display, an electroluminescence display and a plasma display to expose the light-sensitive material directly or through an optical system.

As described above, light sources and exposing methods described in U.S. Pat. No. 4,500,626, column 56, JP-A-2-53378 and JP-A-2-54672, such as natural light, a tungsten lamp, a light emitting diode, a laser source and a CRT light source, can be used to record an image on the heat developable color light-sensitive material.

Further, the image exposure can also be carried out using a wavelength converting element in which a non-linear optical material is combined with a coherent light source such as a laser beam. Here, the non-linear optical material is a material which can express non-linearity between an electrical field and polarization appearing when a strong optical electrical field such as a laser beam is applied. Examples of such material preferably used include an inorganic compound represented by lithium niobate, potassium dihydrogenphosphate (KDP), lithium iodate and $BaB_2O_4$, a urea derivative, a nitroaniline derivative, a nitropyridine-N-oxide derivative such as 3-methyl-4-nitropyridine-N-oxide (POM), and compounds described in JP-A-61-53462 and JP-A-62-210432. As the form of the wavelength converting element, a single crystal optical waveguide type element and a fiber type element are known, and both are useful.

Furthermore, image signals obtained from a video camera or electronic still cameras, television signal represented by the Nippon Television Signal Code (NTSC), image signals obtained by dividing an original into plural pixels with a scanner and image signals produced by use of a computer represented by CG and CAD can be utilized as image information.

The heat developable color light-sensitive material and/or the dye fixing element may have a conductive exothermic layer as heating means for heat development or diffusion transfer of dyes. In this case, exothermic elements described, for example, in JP-A-61-145544 can be utilized.

Although the heating temperature in the heat development stage is from about 50° C. to about 250° C., it is particularly useful to conduct heat development at a heating temperature of about 60° C. to about 180° C. Diffusion transfer of dyes may be carried out either concurrently with the heat development or after the termination of the heat development. In the latter case, the transfer can be achieved at a heating temperature ranging from room temperature to the temperature in the heat development stage, more preferably at a temperature ranging from 50° C. to a temperature about 10° C. lower than the temperature in the heat development stage.

The movement of dyes takes place even only by heat. However, a solvent may be used for accelerating the movement of dyes. As described in U.S. Pat. Nos. 4,704,345 and 4,740,445 and JP-A-61-238056, it is also useful to carry out heating in the presence of a small amount of solvent (particularly, water) to conduct development and transfer at the same time or continuously. In this system, the heating temperature is preferably 50° C. to the boiling point of the solvent. For example, when the solvent is water, the heating temperature is desirably from 50° C. to 100° C.

Examples of the solvent used for acceleration of development and/or diffusion transfer of dyes include water, a basic aqueous solution containing an inorganic alkali metal salt or organic base (the base described for the image formation accelerating agent is used as the base), a low boiling solvent, and a mixed solution of a low boiling solvent and water or the above-described basic aqueous solution. Furthermore, surfactants, antifoggants, complex-formable compounds with hardly soluble metal salts, antifungal agents and sterilizers may be contained in the solvent.

Water is preferably used as the solvent used in the heat development stage and the diffusion transfer stage. Any water may be used as long as it is ordinarily employed. Specifically, distilled water, tap water, well water or mineral water can be used. In heat developing equipment in which the heat developable light-sensitive material and the dye fixing element are processed, water may be used in the disposable form, or repeatedly circulated. The latter case results in use of water containing components eluted from the light-sensitive material. Further, equipment and water described in JP-A-63-144354, JP-A-63-144355, JP-A-62-38460 and JP-A-3-210555 may be used.

The solvent can be provided to either or both the heat developable color light-sensitive material and the dye fixing element. The amount thereof used may be the weight of solvent corresponding to the maximum swollen volume of the whole coated layers or less.

For example, methods described in JP-A-62-253159, page 5, JP-A-63-85544 and JP-A-8-181045 are preferably used for applying the water. Further, a solvent enclosed in microcapsules or hydrated can also be previously contained in either or both the heat developable light-sensitive material and the dye fixing element.

The temperature of water to be applied may be from 30° C. to 60° C. as described in JP-A-63-85544. In particular, in order to prevent bacteria in water from propagation, it is useful to keep the temperature of water at 45° C. or more.

In order to accelerate the movement of dyes, a hydrophilic heat solvent which is solid at ordinary temperature and soluble at high temperature can also be contained in the heat developable light-sensitive material and/or the dye fixing element. The hydrophilic heat solvent may be contained in any of the light-sensitive silver halide emulsion layer, the intermediate layer, the protective layer and the dye fixing layer. However, it is preferred to be contained in the dye fixing layer and/or adjacent layer thereto.

Examples of the hydrophilic heat solvent include urea derivatives, pyridine derivatives, amides, sulfonamides, imides, alcohols, oximes and other heterocyclic compounds.

Heating method in the development and/or transfer stage includes a method of bringing the light-sensitive material and the dye fixing element into contact with a heated block, a heated plate, a hot presser, a heat roll, a heat drum, a halogen lamp heater, an infrared or far infrared lamp heater, and a method of passing them through an atmosphere of high temperature.

As the method for superposing the heat developable light-sensitive material on the dye fixing element, methods described in JP-A-62-253159 and JP-A-61-147244, page 27 can be applied.

Any of various heat development devices can be used for processing the photographic material of the present invention. For example, devices described in JP-A-59-75247, JP-A-59-177547, JP-A-59-181353, JP-A-60-18951, JP-A-U-62-25994 (the term "JP-A-U" as used herein means an "unexamined published Japanese utility model application"), and JP-A-6-130509, JP-A-6-95338 and JP-A-6-95267 are preferably used. As commercially available devices, Pictrostat 100, Pictrostat 200, Pictrography 3000 and Pictrography 2000 manufactured by Fuji Photo Film Co., Ltd. are preferably used.

When the above-described image obtained by the heat developable color light-sensitive material and the dye fixing element are used as a color proof for printing, its density may be expressed by any of continuous gradation control, area gradation control utilizing discontinuous density portions and combined gradation control of both.

Use of LD or LED as the exposure light source permits the output of digital signals. This makes it possible to perform a process comprising controlling images on a CRT for the design and color tone of printed matter and outputting a color proof as the final output (DDCP). That is, the DDCP becomes an effective means for efficiently outputting a proof in the field of the color proof. This is because a color printer is relatively simply constructed and inexpensive, and necessitates no formation of a platemaking film and a printing plate (PS plate), permitting easy formation of a plurality of hard copies having images formed on sheets for a short period of time, as well known.

When LD or LED is used as the exposure light source, it is preferred that three spectral sensitivities of yellow, magenta and cyan, four spectral sensitivities of yellow, magenta, cyan and black, or spectral sensitivities of respective colors obtained by mixing two or more kinds of coloring materials have peaks of spectral sensitivities at different wavelengths 20 nm or more apart from each other. Further, there is another method of obtaining an image having two or more kinds of colors by one exposure wavelength, when two or more different spectral sensitivities have a sensitivity difference of 10 times or more.

Now, a method for reproducing moire on printed matter with a color printer will be described below.

For preparing a printing color proof for faithfully reproducing moire on high-resolution printed matter with a low-resolution color printer, each is converted to bit map data b'j of 48800 DPI, with reference to threshold value matrix 24 for each of dot area rate data aj of four plates of CMYK. Next, the area rate ci of each color is counted, with reference to the bit map data b'j within a definite range at the same time. Then, the first tristimulus value data X, Y and Z of 1600 DPI, i.e., colorimetric value data of the above-described respective colors previously determined, are calculated. An anti-alias filter treatment is conducted to the first tristimulus value data X, Y and Z to calculate the second tristimulus value data X', Y' and Z' of 400 DPI. The resulting calculated data are used as input data for the color printer (the above being described in detail in JP-A-8-192540).

When color images are recorded using an output device such as a color printer, it is possible to realize the color images having desired colors by operating color signals regarding, for example, yellow, magenta and cyan. However, the above-described color signals depend on the output characteristics of the output device, so that color signals supplied from an external device different from the output device in characteristics are required to be processed by color conversion treatment, taking into account the above-described output characteristics.

There is a method which comprises preparing a plurality of known color patches different in color using the output device, measuring the color of the above-described color patches, to thereby obtain, for example, a conversion relation by which known color signals CMY of the color patches are converted to stimulus value signals XYZ independent of the output device (this conversion relation is hereinafter referred to as a "regular conversion relation", then obtaining a conversion relation by which the stimulus value signals XYZ are converted to the color signals CMY utilizing the above-described regular conversion relation (this conversion relation is hereinafter referred to as a "reverse conversion relation), and conducting the above-described color conversion treatment using the reverse conversion relation.

The methods of determining the color signals CMY from the above-described stimulus value signals XYZ include the following three examples, but the present invention should not be construed as being limited thereto.

1. A method comprising establishing a tetrahedron whose vertexes are stimulus value signals XYZ of 4 points, dividing a space of the stimulus value signals XYZ with this tetrahedral, also similarly dividing a space of color signals CMY with a tetrahedron, and determining the color signals CMY corresponding to appropriate stimulus value signals XYZ in the corresponding tetrahedron by a linear operation.

2. A method of determining color signals CMY corresponding to appropriate stimulus value signals XYZ by repetitive operations using the Newton process (see *Photographic Science and Engineering,* vol. 16, No. 2, pp. 136–143, March-April (1972), "Metameric Color Matching in Subtractive Color Photography").

3. In a color conversion method for converting a color signal from the first color system to the second color system, the method comprising the first step of determining a relation of an real color signal of the above-described first color system obtained from a known real color signal of the above-described second color system, as a first regular conversion relation, the second step of approximating the above-described first regular conversion relation with a monotone function to establish a virtual color signal outside a region comprising the above-described real color signal, the third step of determining a relation of the color signal of the above-described first color system obtained from a color signal composed of the above-described real color signal and the above-described virtual color signal in the above-described second color system, as a second conversion relation, and the fourth step of determining a relation of a color signal of the above-described first color system as a reverse conversion relation by use of repetitive operations. That is, in the color conversion method for converting the color signal from the first color system to the second color system, the real color signal (for example, XYZ signal) of the first color system corresponding to the known real color signal (for example, CMY signal) of the second color system is determined, and then, the first regular conversion relation between these real color signals is approximated with the monotone function to establish the virtual color signal outside the region composed of the above-described real color signal. Then, the reverse conversion relation for converting the above-described first color system to the above-described second color system is obtained from the second regular conversion relation between the second color system comprising the above-described real color signal and the above-described virtual color signal and the first color system, by the repetitive operations represented by the Newton process, and color conversion is performed by use of the reverse conversion relation.

The size of the image obtained from the heat developable color light-sensitive material and the dye fixing element may be any of the standard size of series A, A1 to A6, the kiku size, the standard size of series B, B1 to B6 and the small octavo size. Corresponding to the image size, the width of each of the heat developable light-sensitive material and the dye fixing element can be within the range of 100 mm to 2,000 mm.

The heat developable light-sensitive material and the dye fixing element each may be supplied either in the roll form or in the sheet form. It is also possible to supply one in the roll form and the other in the sheet form.

The present invention will be described in greater detail with reference to the following examples, but the present invention should not be construed as being limited thereto.

EXAMPLE 1

Preparation of light-sensitive silver halide emulsions is described below.

Light-Sensitive Silver Halide Emulsion (1) (Emulsion for the Fifth Layer (680 nm Light-Sensitive Layer))

To an aqueous solution having a composition shown in Table 1 below under well stirring, Solution (I) and Solution (II) each having a composition shown in Table 2 below were simultaneously added over a period of 13 minutes, and 10 minutes after then, Solution (III) and Solution (IV) each having a composition shown in Table 2 below were added over a period of 33 minutes.

TABLE 1

| Composition | |
|---|---|
| $H_2O$ | 620 ml |
| Lime-processed gelatin | 20 g |
| KBr | 0.3 g |
| NaCl | 2 g |
| Silver Halide Solvent (1) | 0.030 g |
| Sulfuric acid (1N) | 16 ml |
| Temperature | 45° C. |

TABLE 2

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| $K_2IrCl_6$ | — | — | — | 0.039 mg |
| Total | Water to make 126 ml | Water to make 132 ml | Water to make 254 ml | Water to make 252 ml |

Silver Halide Solvent (1)

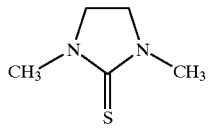

Then, 13 minutes after the initiation of the addition of Solution (III), 150 ml of an aqueous solution containing 0.35% of Sensitizing Dye (1) shown below was added over a period of 27 minutes.

Sensitizing Dye (1)

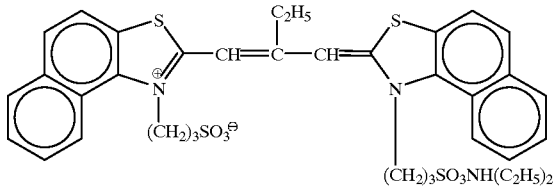

The mixture was washed with water and desalted (performed using Flocculant (a) shown below at a pH of 4.1) according to a conventional method, 22 g of a lime-processed ossein gelatin was added thereto, the pH and the pAg were adjusted to 6.0 and 7.9, respectively, and chemical sensitization was performed at 60° C. The compounds used in the chemical sensitization are shown in Table 3 below. The resulting emulsion in a yield of 630 g was a monodispersed cubic silver chlorobromide emulsion having a coefficient of variation of 10.2% and an average grain size of 0.20 $\mu$m.

TABLE 3

| Chemicals used in Chemical Sensitization | Amount added |
|---|---|
| 4-Hydroxy-6-methyl-1,3,3a,7-tetrazaindene | 0.36 g |
| Sodium thiosulfate | 6.75 mg |
| Antifoggant (1) | 0.11 g |
| Antiseptic (1) | 0.07 g |
| Antiseptic (2) | 3.13 g |

Flocculant (a)

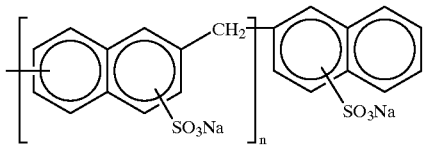

Antifoggant (1)

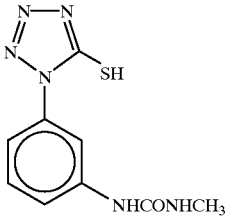

Antiseptic (1)

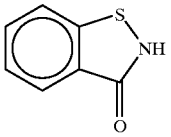

Antiseptic (2)

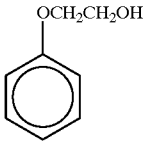

Light-Sensitive Silver Halide Emulsion (2) (Emulsion for the Third Layer (750 nm Light-sensitive Layer))

To an aqueous solution having a composition shown in Table 4 below under well stirring, Solution (I) and Solution (II) each having a composition shown in Table 5 below were simultaneously added over a period of 18 minutes, and 10 minutes after then, Solution (III) and Solution (IV) each having a composition shown in Table 5 below were added over a period of 24 minutes.

TABLE 4

| Composition | |
|---|---|
| $H_2O$ | 620 ml |
| Lime-processed gelatin | 20 g |
| KBr | 0.3 g |
| NaCl | 2 g |
| Silver Halide Solvent (1) | 0.030 g |
| Sulfuric acid (1N) | 16 ml |
| Temperature | 45° C. |

TABLE 5

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| $K_4[Fe(CN)_6].H_2O$ | | | | 0.07 g |
| $K_2IrCl_6$ | — | — | — | 0.040 mg |
| Total | Water to make 188 ml | Water to make 188 ml | Water to make 250 ml | Water to make 250 ml |

The mixture was washed with water and desalted (performed using Flocculant (b) shown below at a pH of 3.9) according to a conventional method, 22 g of a lime-processed ossein gelatin subjected to removal of calcium (calcium content: 150 ppm or less) was added and redispersed at 40° C., 0.39 g of 4-hydroxy-6-methyl-1,3,3a,7-tetrazaindene was added thereto, and the pH and the pAg were adjusted to 5.9 and 7.8, respectively. Thereafter, chemical sensitization was performed at 70° C. using chemicals shown in Table 6 below. At the final of the chemical sensitization, Sensitizing Dyes (a) and (b) as a methanol solution (solution having a composition shown in Table 7 below) were added. Further, after the chemical sensitization, the temperature was lowered to 40° C., 200 g of a gelatin dispersion of Stabilizer (1) shown below was added and well stirred, and then the mixture was stored. The resulting emulsion in a yield of 938 g was a monodispersed cubic silver chlorobromide emulsion having a coefficient of variation of 12.6% and an average grain size of 0.25 μm.

Flocculant (b)

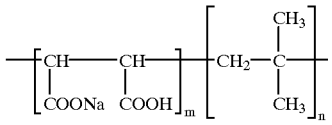

Antifoggant (2)

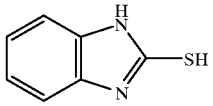

Sensitizing Dye (a)

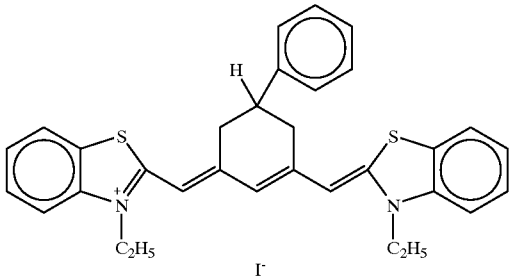

Sensitizing Dye (b)

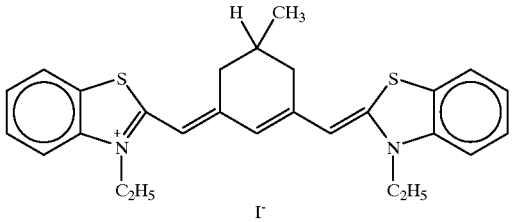

TABLE 6

| Chemicals used in Chemical Sensitization | Amount added |
|---|---|
| 4-Hydroxy-6-methyl-1,3,3a,7-tetrazaindene | 0.39 g |
| Triethylthiourea | 3.3 mg |
| Nucleic acid decomposition product | 0.39 g |
| NaCl | 0.15 g |
| KI | 0.12 g |
| Antifoggant (2) | 0.10 g |
| Antiseptic (1) | 0.07 g |

TABLE 7

| Composition of Dye Solution | Amount added |
|---|---|
| Sensitizing Dye (a) | 0.12 g |
| Sensitizing Dye (b) | 0.06 g |
| p-Toluenesulfonic acid | 0.71 g |
| Methanol | 18.7 ml |

Light-Sensitive Silver Halide Emulsion (3) (Emulsion for the First Layer (810 nm Light-sensitive Layer))

To an aqueous solution having a composition shown in Table 8 below under well stirring, Solution (I) and Solution (II) each having a composition shown in Table 9 below were simultaneously added over a period of 18 minutes, and 10 minutes after then, Solution (III) and Solution (IV) each having a composition shown in Table 9 below were added over a period of 24 minutes.

TABLE 8

| Composition | |
|---|---|
| $H_2O$ | 620 ml |
| Lime-processed gelatin | 20 g |
| KBr | 0.3 g |
| NaCl | 2 g |
| Silver Halide Solvent (1) | 0.030 g |
| Sulfuric acid (1N) | 16 ml |
| Temperature | 50° C. |

TABLE 9

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.1 g |
| NaCl | — | 3.62 g | — | 2.4 g |
| $K_2IrCl_6$ | — | — | — | 0.020 mg |
| Total | Water to make 180 ml | Water to make 181 ml | Water to make 242 ml | Water to make 250 ml |

The mixture was washed with water and desalted (performed using Flocculant (a) at a pH of 3.8) according to a conventional method, 22 g of a lime-processed ossein gelatin was added, the pH and the pAg were adjusted to 7.4 and 7.8, respectively, and chemical sensitization was performed at 60° C. The chemicals used in the chemical sensitization are shown in Table 10 below. The resulting emulsion in a yield of 680 g was a monodispersed cubic silver chlorobromide emulsion having a coefficient of variation of 9.7% and an average grain size of 0.32 μm.

TABLE 10

| Chemicals used in Chemical Sensitization | Amount added |
|---|---|
| 4-Hydroxy-6-methyl-1,3,3a,7-tetrazaindene | 0.38 g |
| Triethylthiourea | 3.10 mg |
| Antifoggant (2) | 0.19 g |
| Antiseptic (1) | 0.07 g |
| Antiseptic (2) | 3.13 g |

A preparation method of a gelatin dispersion of colloidal silver is described below.

To a well stirred aqueous solution having a composition shown in Table 11 below, a solution having a composition shown in Table 12 below was added over a period of 24 minutes. Thereafter, the mixture was washed with water using Flocculant (a), then 43 g of a lime-processed ossein gelatin was added, and the pH was adjusted to 6.3. The average grain size thereof was 0.02 μm and the yield was 512 g (dispersion containing 2% of silver and 6.8% of gelatin).

TABLE 11

| Composition | |
|---|---|
| $H_2O$ | 620 ml |
| Dextrin | 16 g |
| NaOH (5N) | 41 ml |
| Temperature | 30° C. |

TABLE 12

| Composition | |
|---|---|
| $H_2O$ | 135 ml |
| $AgNO_3$ | 17 g |

A preparation method of a gelatin dispersion of each hydrophobic additive is described below.

A gelatin dispersion of each of a yellow dye providing compound, a magenta dye providing compound and a cyan dye providing compound was prepared according to the formulation shown in Table 13 below. More specifically, each oil phase component was dissolved under heating at about 70° C. to form a uniform solution, an aqueous phase component heated at about 60° C. was added to the solution, and the components were mixed under stirring and then dispersed in a homogenizer for 10 minutes at 1,000 rpm. Water was added thereto and the mixture was stirred to obtain a homogenous dispersion. Then, the gelatin dispersion of the cyan dye providing compound was subjected to repetition of dilution with water and concentration using an ultrafiltration module (Ultrafiltration Module ACV-3050, manufactured by Asahi Chemical Industry Co., Ltd.) to reduce the weight of ethyl acetate to 1/17.6 of the weight of ethyl acetate shown in Table 13 below.

TABLE 13

| | Composition of Dispersion | | |
|---|---|---|---|
| | Yellow | Magenta | Cyan |
| Oil phase | | | |
| Cyan Dye Providing Compound (1) | — | — | 7.3 g |
| Cyan Dye Providing Compound (2) | — | — | 10.7 g |
| Magenta Dye Providing Compound (1) | — | 8.8 g | — |
| Magenta Dye Providing Compound (2) | — | 5.5 g | — |
| Yellow Dye Providing Compound (1) | 12.3 g | — | — |
| Reducing Agent (1) | 0.9 g | 0.2 g | 1.0 g |
| Antifoggant (3) | 0.1 g | — | 0.2 g |
| Antifoggant (4) | — | 0.7 g | — |
| Development Accelerator (1) | — | 0.3 g | — |
| Surfactant (1) | 1.1 g | — | — |
| High Boiling Point Solvent (1) | 6.2 g | — | 4.6 g |
| High Boiling Point Solvent (2) | — | 7.4 g | 4.9 g |
| High boiling Point Solvent (3) | — | — | 1.2 g |
| Dye (a) | 1.1 g | — | 0.5 g |
| Ethyl acetate | 9.6 ml | 50.1 ml | 55.2 ml |
| Aqueous phase | | | |
| Lime-processed gelatin | 10.0 g | 10.0 g | 10.0 g |
| Potassium nitrate | 0.1 g | 0.1 g | — |
| Surfactant (1) | — | 0.2 g | 0.8 g |
| Sodium hydroxide aq. soln. (1N) | — | 1.9 ml | — |
| Carboxymethyl cellulose | — | — | 0.3 g |
| Water | 26.1 ml | 139.7 ml | 95.9 ml |
| Water added | 99.9 ml | 157.3 ml | 209.0 ml |
| Antiseptic (1) | 0.004 g | 0.04 g | 0.1 g |

Cyan Dye Providing Compound (1)
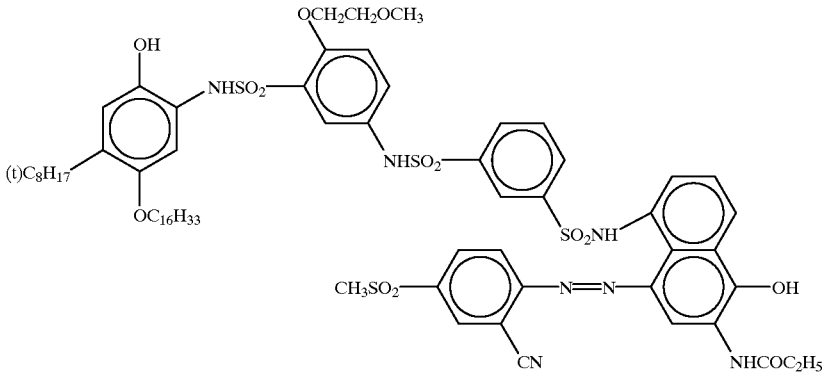
Cyan Dye Providing Compound (2)
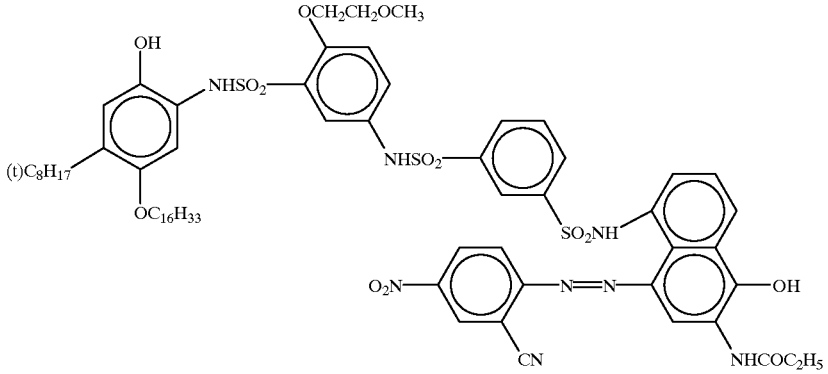
Magenta Dye Providing Compound (1)
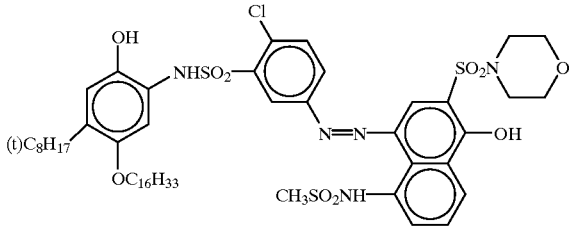
Magenta Dye Providing Compound (2)
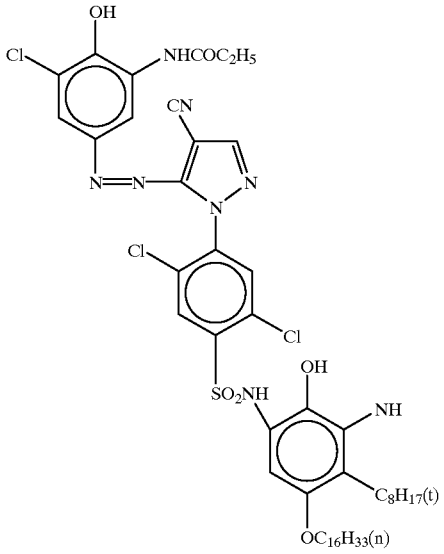

Yellow Dye Providing Compound (1)

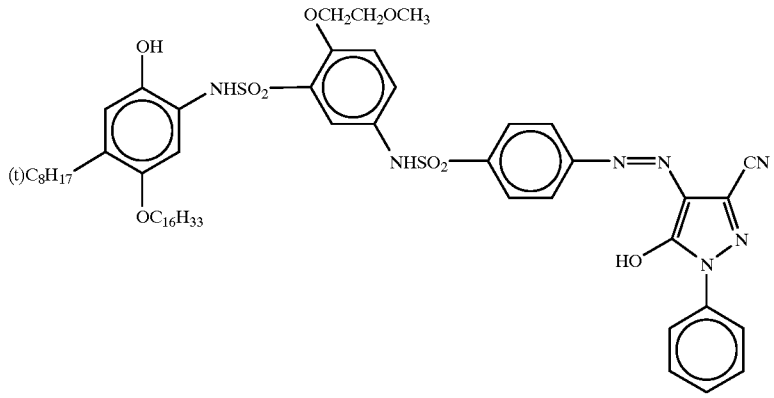

Reducing Agent (1)

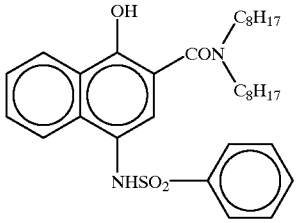

Antifoggant (3)

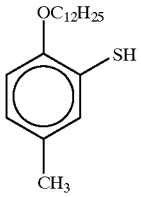

Antifoggant (4)

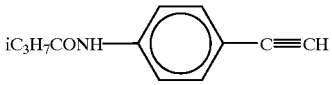

Surfactant (1)

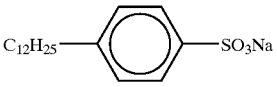

Development Accelerator (1)

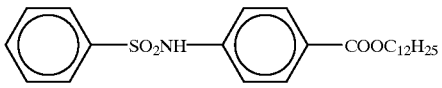

High Boiling Point Solvent (1)

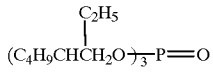

High Boiling Point Solvent (2)

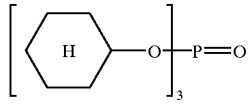

High Boiling Point Solvent (3)

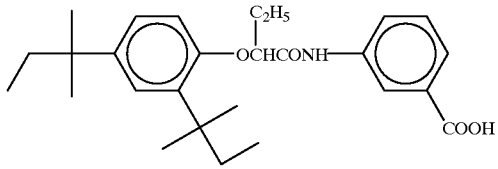

Dye (a)

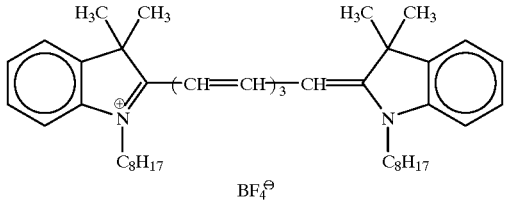

A gelatin dispersion of Reducing Agent (2) was prepared according to the formulation shown in Table 14 below. More specifically, each oil phase component was dissolved under heating at about 60° C., an aqueous phase component heated at about 60° C. was added to the solution, and the components were mixed under stirring and then dispersed in a homogenizer for 10 minutes at 1,000 rpm to obtain a homogenous dispersion. From the resulting dispersion, ethyl acetate was removed using a reduced-pressure organic solvent-removing device.

TABLE 14

| Composition of Dispersion | |
|---|---|
| Oil phase | |
| Reducing Agent (2) | 7.5 g |
| High Boiling Point Solvent (1) | 4.7 g |
| Surfactant (1) | 1.9 g |
| Ethyl acetate | 14.4 ml |
| Aqueous phase | |
| Acid-processed gelatin | 10.0 g |
| Antiseptic (1) | 0.02 g |
| Antiseptic (3) | 0.04 g |
| Sodium hydrogensulfite | 0.1 g |
| Water | 136.7 ml |

Reducing Agent (2)

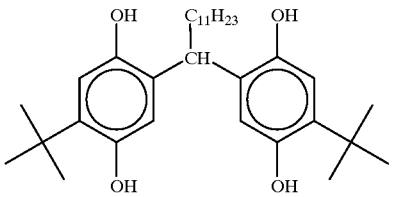

Antiseptic (3)

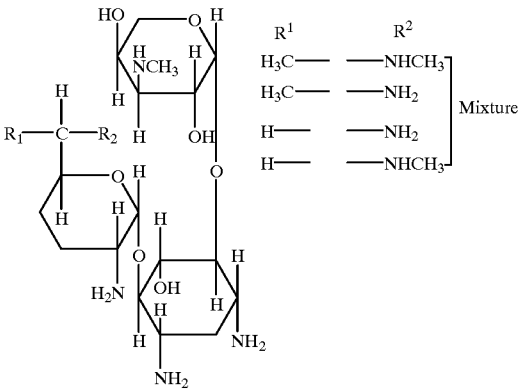

A gelatin dispersion of Stabilizer (1) was prepared according to the formulation shown in Table 15 below. More specifically, each oil phase component was dissolved at room temperature, an aqueous phase component heated at about 40° C. was added to the solution, and the components were mixed while stirring and dispersed in a homogenizer for 10 minutes at 1,000 rpm. Water was added thereto and stirred to obtain a homogenous dispersion.

TABLE 15

| Composition of Dispersion | |
|---|---|
| Oil phase | |
| Stabilizer (1) | 4.0 g |
| Sodium hydroxide | 0.3 g |
| Methanol | 62.8 g |
| High Boiling Point Solvent (4) | 0.9 g |

TABLE 15-continued

| Composition of Dispersion | |
|---|---|
| Aqueous phase | |
| Gelatin subjected to removal of calcium (Ca content: 100 ppm or less) | 10.0 g |
| Antiseptic (1) | 0.04 g |
| Water | 320 ml |

Stabilizer (1)

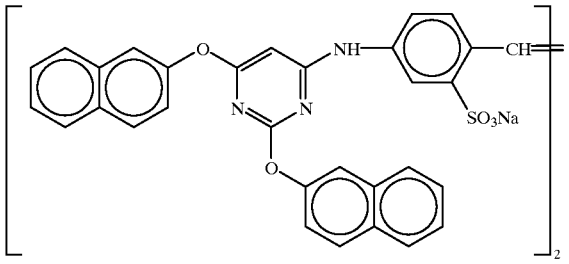

High Boiling Point Solvent (4) (Same Compound as Antiseptic (2))

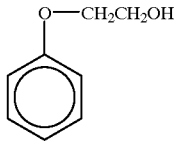

A gelatin dispersion of zinc hydroxide was prepared according to the formulation shown in Table 16 below. More specifically, respective components were mixed, dissolved and dispersed for 30 minutes in a mill together with glass beads having an average particle size of 0.75 mm. The glass beads were separated and removed to obtain a homogenous dispersion. The zinc hydroxide used had an average particle size of 0.25 $\mu$m.

TABLE 16

| Composition of Dispersion | |
|---|---|
| Zinc hydroxide | 15.9 g |
| Carboxy methyl cellulose | 0.7 g |
| Sodium polyacrylate | 0.07 g |
| Lime-processed gelatin | 4.2 g |
| Water | 100 ml |
| High Boiling Point Solvent (4) | 0.4 g |

A preparation method of a gelatin dispersion of a matting agent added to the protective layer is described below. PMMA was dissolved in methylene chloride and the resulting solution was added to gelatin together with a slight amount of a surfactant and dispersed while stirring at a high revolution speed. Then, methylene chloride was removed using a reduced-pressure solvent-removing device to obtain a homogenous dispersion having an average particle size of 4.3 $\mu$m.

Using the above-described compounds and additives, Heat Developable Light-sensitive Material Sample 101 shown in Table 17 below was prepared.

TABLE 17

Main Construction of Heat Developable Light-Sensitive Material Sample 101

| Layer | Name of Layer | Additives | Coating Amount (mg/m$^2$) |
|---|---|---|---|
| Seventh Layer | Protective Layer | Acid-processed gelatin | 442 |
| | | Reducing Agent (2) | 47 |
| | | High Boiling Point Solvent (1) | 30 |
| | | Colloidal silver grain | 2 |
| | | Matting agent (PNONA resin) | 17 |
| | | Surfactant (2) | 16 |
| | | Surfactant (1) | 9 |
| | | Surfactant (3) | 2 |
| Sixth Layer | Interlayer | Lime-processed gelatin | 862 |
| | | Zinc hydroxide | 480 |
| | | Water-soluble Polymer (1) | 4 |
| | | Surfactant (2) | 0.4 |
| | | Calcium nitrate | 14 |
| Fifth Layer | Red-Sensitive Layer | Lime-processed gelatin | 452 |
| | | Light-Sensitive Silver as Ag Halide Emulsion (1) | 301 |
| | | Magenta Dye Providing Compound (1) | 265 |
| | | Magenta Dye Providing Compound (2) | 166 |
| | | Development Accelerator (1) | 9 |
| | | High Boiling Point Solvent (2) | 221 |
| | | Reducing Agent (1) | 6 |
| | | Antifoggant (4) | 20 |
| | | Surfactant (1) | 0.3 |
| | | Water-Soluble Polymer (1) | 11 |
| Fourth Layer | Interlayer | Lime-processed gelatin | 485 |
| | | Zinc hydroxide | 270 |
| | | Water-Soluble Polymer (1) | 2 |
| | | Surfactant (2) | 0.3 |
| | | Calcium nitrate | 8 |
| Third Layer | Second Infrared-Sensitive Layer | Lime-processed gelatin | 373 |
| | | Light-Sensitive Silver as Ag Halide Emulsion (1) | 106 |
| | | Stabilizer (1) | 9 |
| | | Cyan Dye Providing Compound (2) | 233 |
| | | Cyan Dye Providing Compound (1) | 159 |
| | | Dye (a) | 10 |
| | | High Boiling Point Solvent (1) | 101 |
| | | High Boiling Point Solvent (2) | 108 |
| | | High Boiling Point Solvent (3) | 27 |
| | | Reducing Agent (1) | 22 |
| | | Antifoggant (3) | 4 |
| | | Surfactant (1) | 0.9 |
| | | Carboxymethyl cellulose | 5 |
| | | Water-Soluble Polymer (1) | 11 |
| Second Layer | Interlayer | Lime-processed gelatin | 438 |
| | | Surfactant (2) | 4 |
| | | Surfactant (4) | 123 |
| | | Water-Soluble Polymer (2) | 26 |
| | | Antifoggant (5) | 6 |
| | | Calcium nitrate | 8 |
| First Layer | First Infrared-Sensitive Layer | Lime-processed gelatin | 587 |
| | | Light-Sensitive Silver as Ag Halide Emulsion (3) | 311 |
| | | Stabilizer (1) | 8 |
| | | Yellow Dye Providing Compound (1) | 504 |
| | | Sensitizing Dye (4) | 0.1 |
| | | Dye (a) | 44 |
| | | High-Boiling Point Solvent (1) | 252 |
| | | Reducing Aqent (1) | 35 |
| | | Antifoggant (3) | 4 |
| | | Surfactant (1) | 32 |
| | | Water-Soluble Polymer (2) | 46 |
| | | Hardening Agent (1) | 45 |

Support Polyethylene-laminated paper support (thickness: 96 $\mu$m)

Note: Trace additives such as an antiseptic were omitted in the Table above.

Surfactant (2)

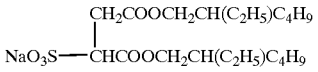

Surfactant (3)

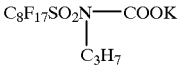

Surfactant (4)

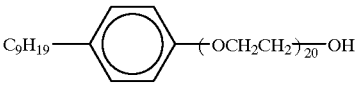

Water-Soluble Polymer (1)

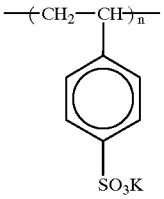

Limiting viscosity number [η] = 1.6 (0.1N NaCl, 30° C.)

Molecular weight ≐ 1,000,000

Water-Soluble Polymer (2)

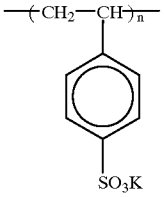

Limiting viscosity number [η] = 0.8 (0.1N NaCl, 30° C.)

Molecular weight ≐ 400,000

Sensitizing Dye (4)

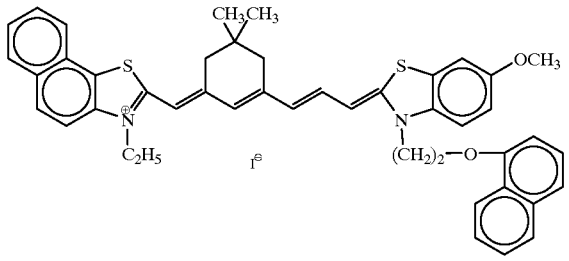

Antifoggant (5)

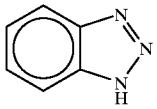

Hardening Agent (1)

$CH_2{=}CHSO_2CH_2SO_2CH{=}CH_2$

Sample 102 to 114 were prepared in the same manner as in Sample 101 except for adding the compound represented by the formula (1) or (2) according to the present invention as shown in Table 19 below to each of the first layer, third layer and fifth layer of Sample 101, respectively. Further, a dispersion of an electron transfer agent (comparative compound) was prepared as shown below, and added as shown in Table 19 below to prepare Samples 115 and 116, respectively.

glycol nonylphenyl ether and 0.5 g of an anionic surfactant shown below as dispersing agents, and the mixture was ground in a mill for 60 minutes together with glass beads having an average particle size of 0.75 mm. The glass beads were separated to obtain an electron transfer agent dispersion having an average particle size of 0.35 $\mu$m.

Electron Transfer Agent

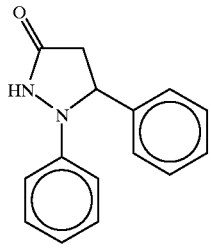

Anionic Surfactant

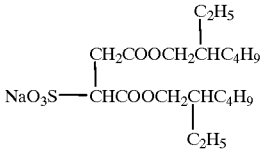

Using these light-sensitive materials and Paper PGSG for Fujix Pictrography 300 manufactured by Fuji Photo Film Co., Ltd., the following procedure was conducted.

The light-sensitive materials were exposed using an exposing device described in FIG. 2 of JP-A-6-127021

TABLE 19

| Sample No. | Compound | Amount(*1) | Cyan Density: Maximum Color Density | Cyan Density: Fog Density | Cyan Density after Preservation: Maximum Color Density | Cyan Density after Preservation: Fog Density | Remarks |
|---|---|---|---|---|---|---|---|
| 101 | None | — | 100 | 7 | 100 | 8 | Comparison |
| 102 | D-2 | 0.2 | 145 | 7 | 146 | 8 | Invention |
| 103 | D-4 | 0.2 | 150 | 6 | 149 | 7 | " |
| 104 | D-9 | 0.2 | 150 | 7 | 150 | 7 | " |
| 105 | D-10 | 0.2 | 151 | 7 | 150 | 7 | " |
| 106 | D-14 | 0.2 | 150 | 7 | 148 | 8 | " |
| 107 | D-15 | 0.2 | 152 | 7 | 149 | 7 | " |
| 108 | D-16 | 0.2 | 148 | 6 | 148 | 7 | " |
| 109 | D-20 | 0.2 | 148 | 7 | 149 | 7 | " |
| 110 | D-22 | 0.2 | 152 | 7 | 150 | 8 | " |
| 111 | D-23 | 0.2 | 150 | 6 | 147 | 8 | " |
| 112 | D-6 | 0.1 | 149 | 6 | 148 | 7 | " |
| 113 | D-6 | 0.2 | 150 | 7 | 149 | 7 | " |
| 114 | D-6 | 0.4 | 152 | 7 | 150 | 7 | " |
| 115 | Electron transfer agent | 0.05 | 152 | 15 | 135 | 12 | Comparison |
| 116 | Electron transfer agent | 0.2 | 155 | 103 | 150 | 82 | " |

Amount(*1): % by mole to the dye providing compound in each layer

A preparation method of a dispersion of an electron transfer agent is described below.

To a 5% aqueous gelatin solution were added 10 g of an electron transfer agent shown below, 0.5 g of polyethylene under the condition shown in Table 20 below and subjected to heat development processing at 83° C. for 17 seconds using a Fujix Pictrography 3000. The condition of heat-development processing was that in which a processing time was shortened compared with the standard condition of 83° C. for 35 seconds.

TABLE 20

| | |
|---|---|
| Beam strength on surface of light-sensitive material | Laser of 675 nm: 60 μW<br>Laser of 755 nm: 250 μW<br>Laser of 815 nm: 250 μW |
| Density of scanning beam | 1600 dpi (63 raster per 1 mm) |
| Diameter of beam | Main scanning direction : 85 ± 8.5 μm<br>Sub-scanning direction : 55 ± 5.5 μm |
| Exposure time | 667μ sec per raster<br>Repeat cycle: 1.33 msec |
| Exposure wavelength | Laser beams of 675 nm, 755 nm and 815 nm |
| Exposure amount | 1 Log E change per 2.5 cm of sub-scanning direction |
| Change method of exposure amount | Emitting time modulation (method described in Japanese Patent Application No. 4-9388) |

Each sample thus-treated was measured by means of an automatic recording color densitometer and the maximum color density and fog density for cyan were obtained. The results are shown in Table 19 using relative values taking the maximum cyan density of Sample 101 as 100.

Further, the light-sensitive material samples were allowed to stand for 2 weeks under conditions of 50° C. and 60% RH and then the same procedure as described above was conducted and the maximum color density and fog density with cyan were evaluated in the same manner as described above. The results obtained are also shown in Table 19.

From the results shown in Table 19, it can be seen that the light-sensitive materials containing the compound of the formula (1) or (2) according to the present invention exhibit the excellent color forming property and low fog density even upon development processing for a short time. They are also excellent in stability during preservation.

Moreover, the same results were obtained when the same evaluations were conducted with magenta and yellow.

EXAMPLE 2

Samples 202 to 216 were prepared in the same manner as in Sample 102 to 116 except for adding the compound represented by the formula (1) or (2) according to the present invention and the electron transfer agent to layers different from those in Samples 102 to 116 of Example 1 as shown in Table 21 below.

Using these samples, the same evaluation as described in Example 1 was performed and the maximum color density and fog density with cyan were determined before and after the preservation. The results obtained are shown in Table 21.

TABLE 21

| | | | | Cyan Density | | Cyan Density after Preservation | | |
|---|---|---|---|---|---|---|---|---|
| Sample No. | Compound | Layer Added | Amount(*1) | Maximum Color Density | Fog Density | Maximum Color Density | Fog Density | Remarks |
| 101 | None | — | — | 100 | 7 | 100 | 8 | Comparison |
| 202 | D-2 | 7th Layer | 0.2 | 143 | 6 | 144 | 8 | Invention |
| 203 | D-4 | 6th Layer | 0.2 | 148 | 6 | 149 | 7 | " |
| 204 | D-9 | 4th Layer | 0.2 | 149 | 6 | 148 | 7 | " |
| 205 | D-10 | 2nd Layer | 0.2 | 150 | 7 | 149 | 7 | " |
| 206 | D-14 | 6th Layer | 0.2 | 150 | 7 | 147 | 8 | " |
| 207 | D-15 | 6th Layer | 0.2 | 150 | 6 | 147 | 7 | " |
| 208 | D-16 | 2nd Layer | 0.2 | 148 | 6 | 147 | 7 | " |
| 209 | D-20 | 2nd Layer | 0.2 | 146 | 7 | 148 | 7 | " |
| 210 | D-22 | 2nd Layer | 0.2 | 150 | 6 | 148 | 8 | " |
| 211(*2) | D-23 | 2nd Layer/ 6th Layer | 0.2 | 149 | 6 | 149 | 8 | " |
| 212 | D-6 | 6th Layer | 0.1 | 147 | 6 | 148 | 7 | " |
| 213 | D-6 | 6th Layer | 0.2 | 148 | 7 | 148 | 7 | " |
| 214 | D-6 | 6th Layer | 0.4 | 151 | 7 | 150 | 7 | " |
| 215 | Electron transfer agent | 6th Layer | 0.05 | 152 | 8 | 130 | 7 | Comparison |
| 216 | Electron transfer agent | 6th Layer | 0.2 | 154 | 45 | 152 | 30 | " |

(*1)Amount: % by mole to all the dye providing compounds in the whole layers.
(*2)In Sample 211, the compound was added to the second layer and sixth layer in a respective amount of 0.1% by mole.

It can be seen that the light-sensitive materials excellent in the rapid processing aptitude and preservation stability can be obtained using the compound according to the present invention same as in Example 1.

EXAMPLE 3

Preparation of light-sensitive silver halide emulsions is described below.

Light-Sensitive Silver Halide Emulsion (1) (for Red-sensitive Emulsion Layer)

To a well stirred aqueous gelatin solution (obtained by adding 800 g of gelatin, 12 g of potassium bromide, 80 g of sodium chloride and 1.2 g of Compound (a) shown below to 26.3 l of water and kept at 53° C.), Solution (I) shown in Table 22 below was added at a constant flow rate over a period of 9 minutes and Solution (II) was added at a constant flow rate starting from 10 seconds before the addition of Solution (I) over a period of 9 minutes and 10 seconds. After 6 minutes, Solution (III) shown in Table 22 was added at a constant flow rate over a period of 24 minutes and Solution (IV) was added simultaneously with Solution (III) at a constant flow rate over a period of 24 minutes and 30 seconds.

The mixture was washed with water and desalted (performed using Flocculant (a) shown below at a pH of 4.0) according to a conventional method, 880 g of a lime-processed ossein gelatin and 2.8 g of Compound (b) shown below were added, the pH was adjusted to 6.0, 12.8 g of a ribonucleic acid decomposed product and 32 mg of trimethylthiourea were added thereto, optimal chemical sensitization was conducted at 60° C. for 71 minutes, and after adding in sequence 2.6 g of 4-hydroxy-6-methyl-1,3,3a,7-tetrazaindene, 3.2 g of Dye (a) shown below, 5.1 g of KBr and 2.6 g of a stabilizer described below, the mixture was cooled. As a result, 28.1 kg of a monodispersed cubic silver chlorobromide emulsion having an average grain size of 0.32 $\mu$m was obtained.

TABLE 22

| | Solution (I) | Solution (II) | Solution (III) | Solution (IV) |
|---|---|---|---|---|
| $AgNO_3$ | 1,200 g | — | 2,800 g | — |
| $NH_4NO_3$ | 2.5 g | — | 2.5 g | — |
| KBr | — | 546 g | — | 1,766 g |
| NaCl | — | 144 g | — | 96 g |
| $K_2IrCl_6$ | — | 3.6 mg | — | — |
| | Water to make 6.5 l | Water to make 6.5 l | Water to make 10 l | Water to make 10 l |

Compound (a)

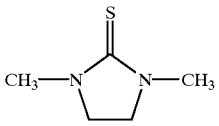

Compound (b)

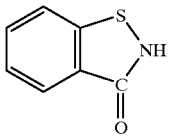

Dye (a)

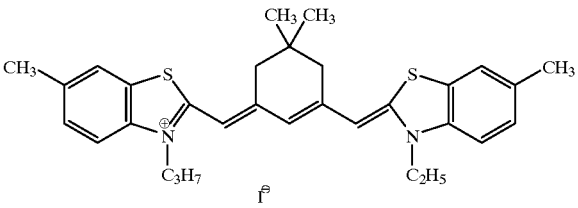

Flocculant (a)

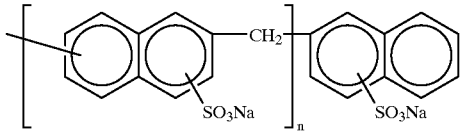

Light-Sensitive Silver Halide Emulsion (2) (for Green-sensitive Emulsion Layer)

To a well stirred aqueous gelatin solution (obtained by adding 20 g of gelatin, 0.3 g of potassium bromide, 2 g of sodium chloride and 30 mg of Compound (a) to 600 ml of water and kept at 46° C.), Solution (I) and Solution (II) shown in Table 23 below were added simultaneously at a constant flow rate over a period of 9 minutes. After 5 minutes, Solution (III) and Solution (IV) shown in Table 23 below were further added simultaneously at a constant flow rate over a period of 32 minutes. Eleven minutes after the beginning of the addition of Solution (III), 100 ml of a 1% aqueous solution of potassium iodide was added. One minute after the completion of the addition of Solution (III) and Solution (IV), 60 ml of a methanol solution of dyes (containing 360 mg of Dye (b1) shown below and 73.4 mg of Dye (b2) shown below) was added collectively.

The mixture was washed with water and desalted (performed using Flocculant (a) at a pH of 4.0) according to a conventional method, 22 g of a lime-processed ossein gelatin was added, the pH and the pAg were adjusted to 6.0 and 7.6, respectively, by adding NaCl and NaOH each in an appropriate amount, 0.18 g of a ribonucleic acid decomposed product, 4.2 mg of sodium thiosulfate and 180 mg of 4-hydroxy-6-methyl-1,3,3a,7-tetrazaindene were added thereto, optimal chemical sensitization was conducted at 60° C., and after adding 90 mg of Antifoggant (1) shown below, the mixture was cooled. Further, 70 mg of Compound (b) and 3 ml of Compound (c) shown below were added as antiseptics. As a result, 635 g of a monodispersed cubic silver chlorobromide emulsion having an average grain size of 0.30 $\mu$m was obtained.

TABLE 23

| | Solution (I) | Solution (II) | Solution (III) | Solution (IV) |
|---|---|---|---|---|
| $AgNO_3$ | 10.0 g | — | 90.0 g | — |
| $NH_4NO_3$ | 0.06 g | — | 0.38 g | — |
| KBr | — | 3.50 g | — | 57.1 g |
| NaCl | — | 1.72 g | — | 3.13 g |
| $K_2IrCl_6$ | — | — | — | 0.03 mg |
| | Water to make 126 ml | Water to make 131 ml | Water to make 280 ml | Water to make 289 ml |

Dye (b1)

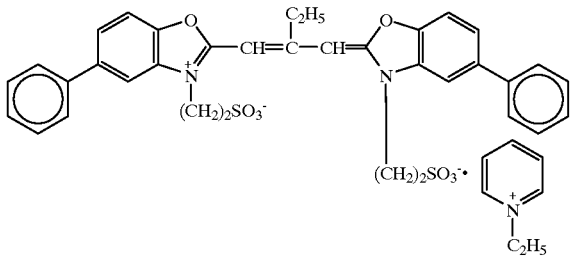

Dye (b2)

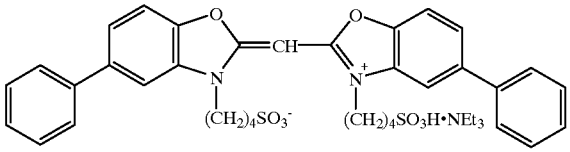

Antifoggant (1)

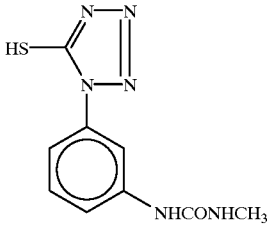

Compound (c)

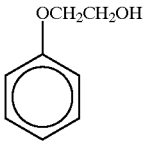

Light-Sensitive Silver Halide Emulsion (3) (for Blue-sensitive Emulsion Layer):

To a well stirred aqueous gelatin solution (obtained by adding 1,582 g of gelatin, 127 g of KBr and 660 mg of Compound (a) to 29.2 l of water and kept at 72° C.), Solution (I) and Solution (II) each having the composition shown in Table 24 below were added such that Solution (I) was added 10 seconds after the initiation of the addition of Solution (II) and each solution was added over a period of 30 minutes. Two minutes after the completion of the addition of Solution (I), Solution (V) was added, 5 minutes after the completion of the addition of Solution (II), Solution (IV) was added, and 10 seconds after then, Solution (III) was added. Solution (III) was added over a period of 27 minutes and 50 seconds and Solution (IV) was added over a period of 28 minutes.

Thereafter, the mixture was washed with water and desalted (conducted using 32.4 g of Flocculant (b) shown below at a pH of 3.9) according to a conventional method, 1,230 g of a lime-processed ossein gelatin and 2.8 mg of Compound (b) were added thereto and the pH and the pAg were adjusted to 6.1 and 8.4. Then, 24.9 mg of sodium thiosulfate was added thereto, optimal chemical sensitization was performed at 65° C. for about 70 minutes and after adding 13.1 g of Dye (c) shown below and 118 ml of Compound (c) in sequence, the mixture was cooled. The silver halide grains of the thus-obtained emulsion were potato-shaped grains, the grain size thereof was 0.53 $\mu$m, and the yield was 30.7 kg.

TABLE 24

| | Solution (I) | Solution (II) | Solution (III) | Solution (IV) | Solution (V) |
|---|---|---|---|---|---|
| $AgNO_3$ | 939 g | — | 3,461 g | — | — |
| $NH_4NO_3$ | 3.4 g | — | 15.4 g | — | — |

TABLE 24-continued

| | Solution (I) | Solution (II) | Solution (III) | Solution (IV) | Solution (V) |
|---|---|---|---|---|---|
| KBr | — | 572 g | — | 2,464 g | — |
| KI | — | — | — | — | 22.0 g |
| | Water to make 6.69 l | Water to make 6.68 l | Water to make 9.70 l | water to make 9.74 l | Water to make 4.40 l |

Flocculant (b)

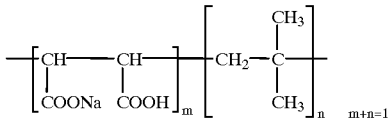

Dye (c)

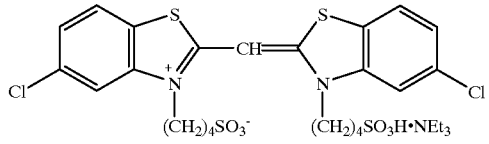

Preparation of a gelatin dispersion of Compound (d) is described below.

Compound (d), High Boiling Point Organic Solvent (1), Compound (f), Compound (g), Compound (h) and Surfactant (1) each shown below were weighed to 0.76 g, 2.27 g, 0.23 g, 0.47 g, 0.10 g and 0.66 g, respectively, and 10 ml of ethyl acetate was added thereto and dissolved under heating at about 60° C. to obtain a uniform solution. The resulting solution and 62.5 g of a 16% aqueous solution of a lime-processed gelatin were mixed while stirring and dispersed in a homogenizer for 10 minutes at 10,000 rpm. After the dispersion, 28 ml of water for dilution was added. The dispersion solution obtained was designated as the dispersion of Compound (d).

Compound (d)

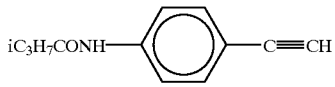

High Boiling Point Organic Solvent (1)

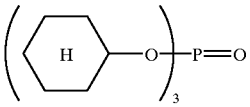

Compound (f)

$C_{26}H_{46.9}Cl_{7.1}$

Compound (g)

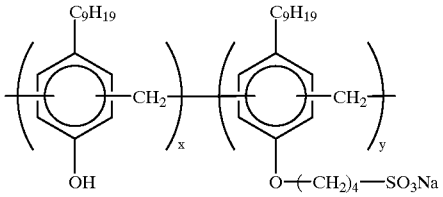

x/y ≒ 58/42

Surfactant (1)

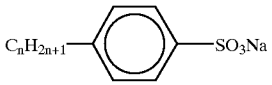

n ≒ 12.6

Compound (h)

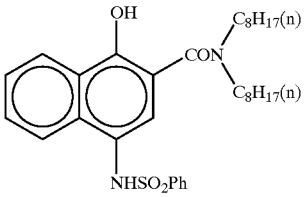

Preparation of a gelatin dispersion of Compound (2) is described below.

Compound (2) shown below, Compound (O) shown below, Compound (d), High Boiling Point Organic solvent (1), Compound (f), Compound (g), Compound (h) and Surfactant (1) were weighed to 0.035 g, 0.017 g, 0.76 g, 2.27 g, 0.23 g, 0.47 g, 0.10 g and 0.66 g, respectively, and 10 ml of ethyl acetate was added thereto and dissolved under heating at about 60° C. to obtain a uniform solution. The resulting solution and 62.5 g of a 16% aqueous solution of a lime-processed gelatin were mixed while stirring and dispersed in a homogenizer for 10 minutes at 10,000 rpm. After the dispersion, 132 ml of water for dilution was added. The dispersion solution was designated as the dispersion of Compound (2).

Compound (O)

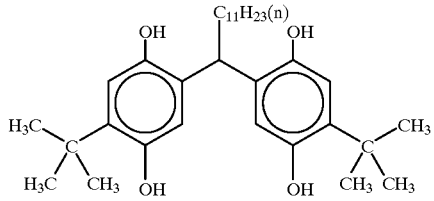

Compound (2)

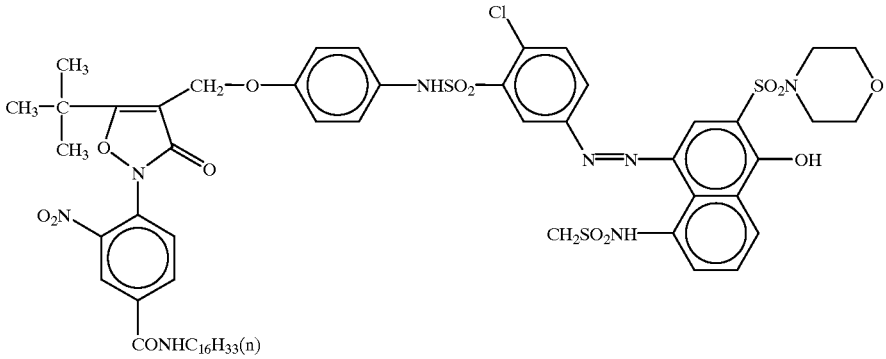

Preparation of a gelatin dispersion of a dye providing compound is described below.

Cyan Dye Providing Compound (A1) shown below, Cyan Dye Providing Compound (A2) shown below, Surfactant (1), Compound (h), Compound (i) shown below, High Boiling Point Organic Solvent (1) and High Boiling Point Organic Solvent (2) shown below were weighed to 7.3 g, 11.0 g, 0.8 g, 1 g, 2.2 g, 7 g and 3 g, respectively, and 26 ml of ethyl acetate and 1.2 ml of water were added thereto and dissolved under heating at about 60° C. to obtain a uniform solution. The resulting solution, 65 g of a 16% aqueous solution of a lime-processed gelatin and 87 ml of water were mixed while stirring and dispersed in a homogenizer for 10 minutes at 10,000 rpm. After the dispersion, 216 ml of water for dilution was added. The resulting dispersion solution was designated as the dispersion of cyan dye providing compound.

Cyan Dye Providing Compound (A1)

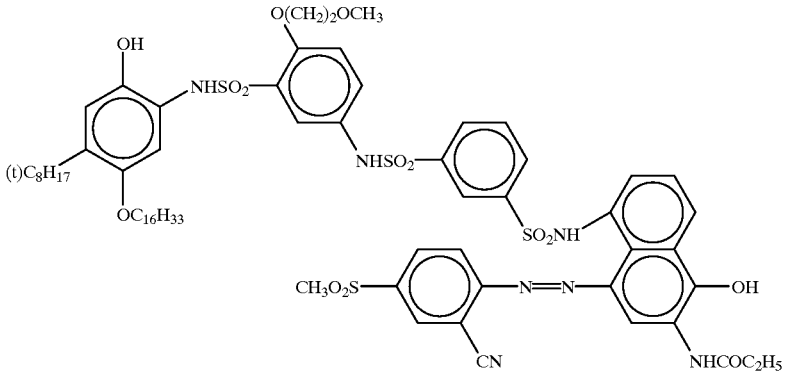

Cyan Dye Providing Compound (A2)

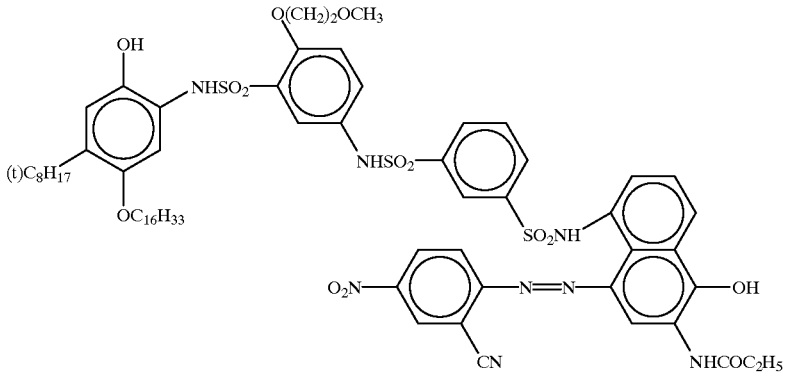

Compound (h)

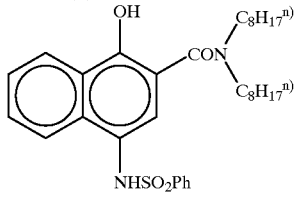

Compound (i)

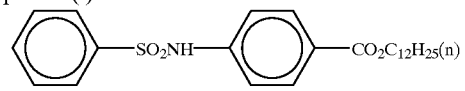

High Boiling Point Organic Solvent (2)

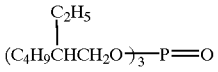

Magenta Dye Providing Compound (B) shown below, Compound (m) shown below, Compound (h), Compound (n) shown below, Surfactant (1) and High Boiling Point Organic Solvent (2) were weighed to 4.57 g, 0.051 g, 0.051 g, 0.032 g, 0.094 g and 2.3 g, respectively, and 12 ml of ethyl acetate was added thereto and dissolved under heating at about 60° C. to obtain a uniform solution. The resulting solution, 15.4 g of a 16% aqueous solution of a lime-processed gelatin and 23.7 ml of water were mixed while stirring and dispersed in a homogenizer for 10 minutes at 10,000 rpm. Thereafter, 43 ml of water for dilution was added. The resulting dispersion solution was designated as the dispersion of magenta dye providing compound.

Magenta Dye Providing Compound (B)

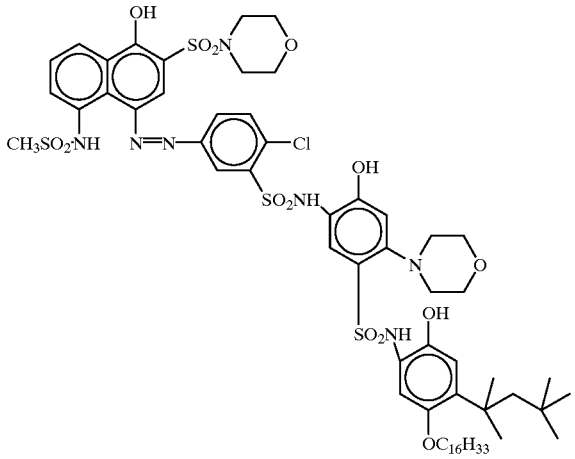

Compound (m)

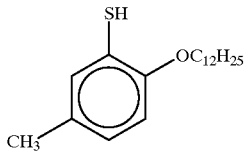

Compound (n)

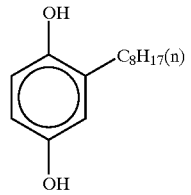

Yellow Dye Providing Compound (C) shown below, Compound (d), Compound (h), Surfactant (1), Compound (j) shown below, Compound (k) shown below and High Boiling Point Organic Solvent (1) were weighed to 15 g, 2.3 g, 0.9 g, 0.88 g, 3.9 g, 1.9 g and 16.9 g, respectively, and 49 ml of ethyl acetate was added thereto and dissolved under heating at about 60° C. to obtain a uniform solution. The resulting solution, 63.5 g of a 16% aqueous solution of a lime-processed gelatin and 103 ml of water were mixed while stirring and dispersed in a homogenizer for 10 minutes at 10,000 rpm. Thereafter, 94 ml of water for dilution was added. The resulting dispersion solution was designated as the dispersion of yellow dye providing compound.

Yellow Dye Providing Compound (C)

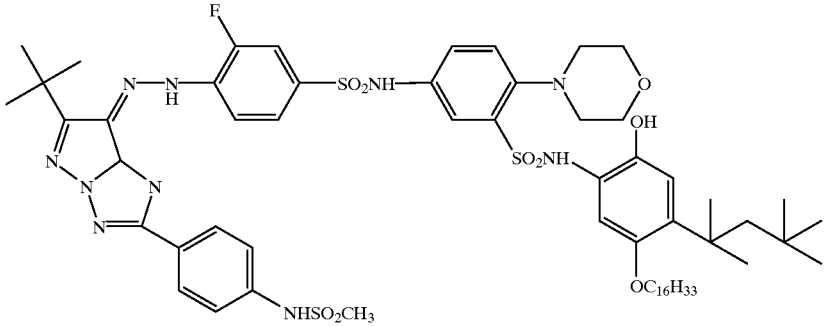

Compound (j)

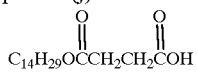

Compound (k)

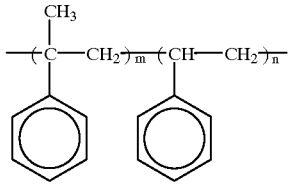

Using these, Heat Developable Light-Sensitive Material Sample 301 having a composition shown in Table 25 was prepared. As a dispersion of zinc hydroxide, the same dispersion as described in Example 1 was used.

TABLE 25

Composition of Light-Sensitive Material (Light-Sensitive Material Sample 301)

| Layer | Name of Layer | Additives | Coating Amount ($g/m^2$) |
|---|---|---|---|
| Seventh Layer | Protective Layer | Acid-processed gelatin | 0.408 |
| | | PMMA Matting agent | 0.017 |
| | | Surfactant (2) | 0.006 |
| | | Surfactant (3) | 0.017 |
| | | Dye trapping agent | 0.792 |
| Sixth Layer | Interlayer | Gelatin | 0.746 |
| | | $Zn(OH)_2$ | 0.549 |
| | | Surfactant (3) | 0.002 |
| | | Compound (d) | 0.035 |
| | | Compound (f) | 0.011 |
| | | Compound (g) | 0.022 |
| | | Compound (h) | 0.005 |
| | | High Boiling Point Organic Solvent (1) | 0.105 |
| | | $Ca(NO_3)_2$ | 0.019 |
| | | KBr | 0.006 |
| | | Surfactant (3) | 0.030 |
| | | Water-Soluble Polymer (1) | 0.003 |
| Fifth Layer | Blue-sensitive Layer | Silver Halide Emulsion (3) as Ag | 0.392 |
| | | Gelatin | 0.523 |
| | | Yellow Dye Providing Compound (C) | 0.342 |
| | | Compound (d) | 0.053 |
| | | Compound (h) | 0.021 |
| | | Compound (j) | 0.090 |
| | | Compound (k) | 0.044 |
| | | High Boiling Point Organic Solvent (1) | 0.384 |
| | | Surfactant (1) | 0.028 |

TABLE 25-continued

| | | | |
|---|---|---|---|
| | | Water-Soluble Polymer (1) | 0.007 |
| Fourth Layer | Interlayer | Gelatin | 0.457 |
| | | $Zn(OH)_2$ | 0.349 |
| | | Surfactant (3) | 0.001 |
| | | Compound (d) | 0.021 |
| | | Compound (f) | 0.006 |
| | | Compound (g) | 0.013 |
| | | Compound (h) | 0.003 |
| | | High Boiling Point Organic Solvent (1) | 0.064 |
| | | $Ca(NO_3)_2$ | 0.011 |
| | | KBr | 0.004 |
| | | Surfactant (1) | 0.019 |
| | | Water-Soluble Polymer (1) | 0.002 |
| Third Layer | Green-sensitive | Silver Halide Emulsion (2) as Ag | 0.237 |
| | | Gelatin | 0.403 |

TABLE 25-continued

| | | | |
|---|---|---|---|
| | Layer | Magenta Dye Providing Compound (B) | 0.361 |
| | | Compound (m) | 0.004 |
| | | Compound (h) | 0.004 |
| | | Compound (n) | 0.003 |
| | | High Boiling Point Organic Solvent (2) | 0.180 |
| | | Surfactant (1) | 0.011 |
| | | Water-Soluble Polymer (1) | 0.007 |
| Second Layer | Interlayer | Gelatin | 0.503 |
| | | Surfactant (4) | 0.067 |
| | | Surfactant (3) | 0.006 |
| | | Compound (d) | 0.022 |
| | | Compound (f) | 0.007 |
| | | Compound (g) | 0.013 |
| | | Compound (h) | 0.003 |
| | | Compound (2) | 0.0010 |
| | | Compound (O) | 0.0005 |
| | | Compound (1) | 0.019 |
| | | High Boiling Point Organic Solvent (1) | 0.065 |
| | | $Ca(NO_3)_2$ | 0.012 |
| | | Water-Soluble Polymer (1) | 0.019 |
| First Layer | Red-sensitive Layer | Silver Halide Emulsion (1) as Ag | 0.142 |
| | | Gelatin | 0.324 |
| | | Cyan Dye Providing Compound (A1) | 0.111 |
| | | Cyan Dye Providing Compound (A2) | 0.167 |
| | | Compound (i) | 0.033 |
| | | Compound (h) | 0.016 |
| | | High Boiling Point Organic Solvent (1) | 0.047 |
| | | High Boiling Point Organic Solvent (2) | 0.109 |
| | | Surfactant (1) | 0.017 |
| | | Water-Soluble Polymer (1) | 0.013 |
| | | Stabilizer | 0.004 |
| | | Hardening agent (1) | 0.035 |
| Support (1) | | Polyethylene-laminated paper support (thickness: 131 μm) | |

Support (1)

| Layer | Composition | | Thickness (μm) |
|---|---|---|---|
| Front Surface Subbing Layer | Gelatin | | 0.1 |
| Front Surface PE Layer (glossy) | Low-density polyethylene (density: 0.923): | 89.2 parts | 36.0 |
| | Surface-treated titanium oxide: | 10.0 parts | |
| | Ultramarine: | 0.8 parts | |
| Pulp Layer | Wood free paper (LBKP/NBKP = 1/1, density: 1.080) | | 64.0 |
| Back Surface PE Layer (mat) | High-density polyethylene (density: 0.960) | | 31.0 |
| Back Surface Subbing Layer | Gelatin | | 0.05 |
| | Colloidal silica | | 0.05 |
| | | Total | 131.2 |

Surfactant (2)

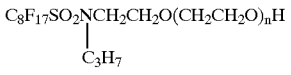

n = 15

Surfactant (3)

Aerosol OT

Surfactant (4)

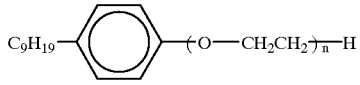

n = 20

Water-Soluble Polymer (1)

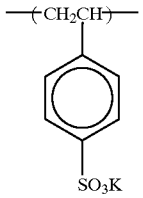

Hardening Agent (1)

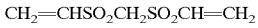

Stabilizer

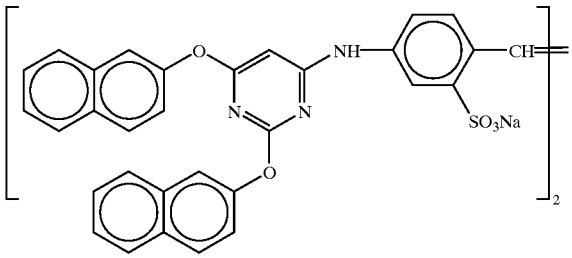

Samples 302 to 316 and 317 to 331 were prepared in the same manner as in Sample 301 except for adding the compound represented by the formula (1) or (2) according to the present invention and an electron transfer agent as shown in Tables 26 and 27, respectively. The amount and layer to which the compound was added were same as those described in Examples 1 and 2, respectively.

TABLE 26

| Sample No. | Compound | Amount(*1) |
|---|---|---|
| 301 | None | — |
| 302 | D-2 | 0.2 |
| 303 | D-4 | 0.2 |
| 304 | D-9 | 0.2 |
| 305 | D-10 | 0.2 |
| 306 | D-14 | 0.2 |
| 307 | D-15 | 0.2 |
| 308 | D-16 | 0.2 |
| 309 | D-20 | 0.2 |
| 310 | D-22 | 0.2 |
| 311 | D-23 | 0.2 |
| 312 | D-6 | 0.1 |
| 313 | D-6 | 0.2 |
| 314 | D-6 | 0.4 |
| 315 | Electron transfer agent | 0.05 |
| 316 | " | 0.2 |

Amount(*1): % by mole to the dye providing compound in each layer

TABLE 27

| Sample No. | Compound | Layer Added | Amount(*1) |
|---|---|---|---|
| 317 | D-2 | 7th Layer | 0.2 |
| 318 | D-4 | 6th Layer | 0.2 |
| 319 | D-9 | 4th Layer | 0.2 |
| 320 | D-10 | 2nd Layer | 0.2 |
| 321 | D-14 | 6th Layer | 0.2 |
| 322 | D-15 | 6th Layer | 0.2 |
| 323 | D-16 | 2nd Layer | 0.2 |
| 324 | D-20 | 2nd Layer | 0.2 |
| 325 | D-22 | 2nd Layer | 0.2 |
| 326(*2) | D-23 | 2nd Layer/ 6th Layer | 0.2 |
| 327 | D-6 | 6th Layer | 0.1 |
| 328 | D-6 | 6th Layer | 0.2 |
| 329 | D-6 | 6th Layer | 0.4 |
| 330 | Electron transfer agent | 6th Layer | 0.05 |
| 331 | Electron transfer agent | 6th Layer | 0.2 |

(*1)Amount: % by mole to all the dye providing compounds in the whole layers (*2)In Sample 326, the compound was added to the second layer and sixth layer in a respective amount of 0.1% by mole.

These samples were subjected to imagewise RGB separation exposure and heat development processing using Paper PS3-SG for Pictrostat 330 manufactured by Fuji Photo Film Co., Ltd. The heat development processing was conducted at 83° C. for 15 seconds using a Pictrostat 330 manufactured by Fuji Photo Film Co., Ltd. The condition of the processing was that in which a processing time was shortened compared with the standard condition of 83° C. for 25 seconds.

The evaluations of each sample was conducted in the same manner as in Examples 1 and 2, and it was found that the light-sensitive materials of the present invention are excellent in the rapid processing aptitude and preservation stability.

According to the present invention, a silver halide color photographic light-sensitive material which provides images excellent in discrimination upon development processing for a very short time and which is excellent in preservation stability can be obtained.

While the invention has been described in detail and with reference to specific embodiments thereof, it will be apparent to one skilled in the art that various changes and modifications can be made therein without departing from the spirit and scope thereof.

What is claimed is:

1. A heat developable color photographic light-sensitive material consisting essentially of at least one dye providing compound represented by the formula (L1) shown below and at least one developing agent represented by the formula (1) or (2) shown below:

$$(\text{Dye-X})_q\text{—Y} \qquad \text{(L1)}$$

wherein Dye represents a dye moiety, or a dye moiety temporarily shifted to a short wavelength; X represents a mere bond or connecting group; Y represents a group having a property of bringing about the difference in diffusibility of the compound represented by $(\text{Dye-X})_q$—Y corresponding to or reversely corresponding to a light-sensitive silver salt having imagewise a latent image, or releasing Dye to generate the difference in diffusibility between Dye released and the compound represented by $(\text{Dye-X})_q$—Y; and q represents 1 or 2, and when q is 2, two Dye-X groups may be the same or different;

(1)

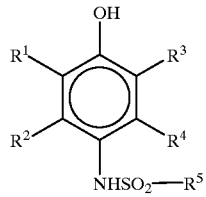

(2)

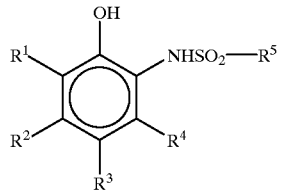

wherein $R^1$, $R^2$, $R^3$ and $R^4$, which may be the same or different, each represents a hydrogen atom, a halogen atom, a cyano group or an alkyl, aryl, heterocyclic, alkoxy, aryloxy, alkylthio, arylthio, alkylcarbonyl, arylcarbonyl, alkylsulfonyl, arylsulfonyl, alkylcarbonamido, arylcarbonamido, alkylsulfonamido, arylsulfonamido, alkylcarbonyloxy, arylcarbonyloxy, carbamoyl, alkylcarbamoyl, arylcarbamoyl, alkoxycarbonyl, aryloxycarbonyl, sulfamoyl, alkylsulfamoyl, arylsulfamoyl, ureido or urethane group having not more than 4 carbon atoms or an I/O value of not less than 1; and $R^5$ represents an alkyl group, an aryl group, a heterocyclic group, an alkylamino group, an arylamino group or a heterocyclic amino group.

2. The heat developable color photographic light-sensitive material as claimed in claim 1, wherein q in the formula (L1) is 1.

3. The heat developable color photographic light-sensitive material as claimed in claim 1, wherein X in the formula (L1) is —$SO_2$NH—.

4. The heat developable color photographic light-sensitive material as claimed in claim 1, wherein Y in the formula (L1) is represented by the following formula (Y-1):

(Y-1)

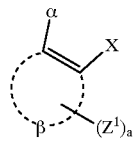

wherein β represents a nonmetallic atomic group necessary for forming a benzene ring, the benzene ring may be condensed with a saturated or unsaturated carbon ring or heterocyclic ring; α represents —$OZ^2$ or —$NHZ^3$, wherein $Z^2$ represents a hydrogen atom or a group which generates a hydroxyl group by hydrolysis; and $Z^3$ represents a hydrogen atom, an alkyl group, an aryl group or a group which generates an amino group by hydrolysis; $Z^1$ represents an alkyl group, an aryl group, an aralkyl group, an alkoxy group, an alkylthio group, an aryloxy group, an arylthio group, an acyl group, a sulfonyl group, an acylamino group, a sulfonylamino group, a carbamoyl group, a sulfamoyl group, a ureido group, a urethane group, a heterocyclic group, which groups each may have a substituent, a cyano group or a halogen atom; a represents a positive integer, and when two or more $Z^1$ groups are present, they may be the same or different; and X represents a group represented by —$NHSO_2Z^4$, wherein $Z^4$ represents a divalent group.

5. The heat developable color photographic light-sensitive material as claimed in claim 1, wherein Y in the formula (L1) is represented by the following formula (Y-2) or (Y-3):

(Y-2)

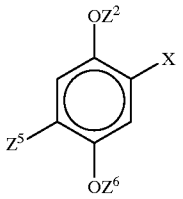

(Y-3)

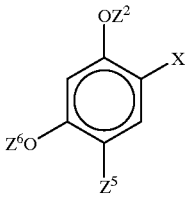

wherein $Z^2$ represents a hydrogen atom or a group which generates a hydroxyl group by hydrolysis; X represents a group represented by —$NHSO_2Z^4$, wherein $Z^4$ represents a divalent group; and $Z^5$ and $Z^6$ each represents an alkyl group, an aryl group or an aralkyl group, which groups e ach may have a substituent.

6. The heat developable color photographic light-sensitive material as claimed in claim 1, wherein Y in the formula (L1) is represented by the following formula (Y-4):

(Y-4)

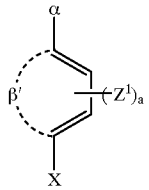

wherein β' represents a nonmetallic atomic group necessary for forming a benzene ring, the benzene ring may be condensed with a saturated or unsaturated carbon ring or heterocyclic ring; a represents —$OZ^2$ or —$NHZ^3$, wherein $Z^2$ represents a hydrogen atom or a group which generates a hydroxyl group by hydrolysis; and $Z^3$ represents a hydrogen atom, an alkyl group, an aryl group or a group which generates an amino group by hydrolysis; $Z^1$ represents an alkyl group, an aryl group, an aralkyl group, an alkoxy group, an alkylthio group, an aryloxy group, an arylthio group, an acyl group, a sulfonyl group, an acylamino group, a sulfonylamino group, a carbamoyl group, a sulfamoyl group, a ureido group, a urethane group, a heterocyclic group, which groups each may have a substituent, a cyano group or a halogen atom; a represents a positive integer, and when two or more $Z^1$ groups are present, they may be the same or different; and X represents a group represented by —$NHSO_2Z^4$, wherein $Z^4$ represents a divalent group.

7. The heat developable color photographic light-sensitive material as claimed in claim 1, wherein Y in the formula (L1) is represented by the following formula (Y-5) or (Y-6):

(Y-5)

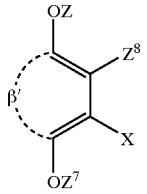

(Y-6)

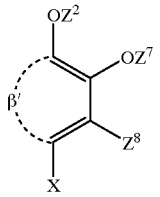

wherein β' represents a nonmetallic atomic group necessary for forming a benzene ring, the benzene ring may be condensed with a saturated or unsaturated carbon ring or heterocyclic ring; α represents —$OZ^2$ or —$NHZ^3$, wherein $Z^2$ represents a hydrogen atom or a group which generates a hydroxyl group by hydrolysis; $Z^3$ represents a hydrogen atom, an alkyl group, an aryl group or a group which generates an amino group by hydrolysis; $Z^7$ has the same meaning as $Z^2$ and $Z^2$ and $Z^7$ may be the same or different; $Z^8$ represents an alkyl group, an aryl group, an aralkyl group, an alkoxy group, an alkylthio group, an aryloxy group, an arylthio group, an acyl group, a sulfonyl group, an acylamino group, a sulfonylamino group, a carbamoyl group, a sulfamoyl group, a ureido group, a urethane group, a heterocyclic group, which groups each may have a substituent, a cyano group, hydrogen atom or a halogen atom; and X represents a group represented by —$NHSO_2Z^4$, wherein $Z^4$ represents a divalent group.

8. The heat developable color photographic light-sensitive material as claimed in claim 1, wherein Y in the formula (L1) is represented by the following formula (Y-7):

(Y-7)

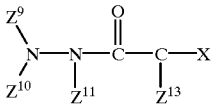

wherein $Z^9$ and $Z^{11}$ each represents a hydrogen atom, a substituted or unsubstituted acyl, alkoxycarbonyl or aryloxycarbonyl group; $Z^{10}$ represents an alkyl group, an aryl group, an aralkyl group, an acyl group, an alkoxycarbonyl group, an aryloxycarbonyl group, a carbamoyl group, a sulfonyl group or a sulfamoyl group; $Z^{12}$ and $Z^{13}$ each represents a hydrogen atom, a substituted or unsubstituted alkyl, aryl or aralkyl group.

9. The heat developable color photographic light-sensitive material as claimed in claim 1, wherein the dye providing compound is a compound which is reductive to silver halide or an organic silver salt and undergoes the reduction thereof to release a diffusible dye.

10. The heat developable color photographic light-sensitive material as claimed in claim 1, wherein the dye providing compound is present in an amount of from 0.01 mmol/$m^2$ to 5 mmol/$m^2$.

11. The heat developable color photographic light-sensitive material as claimed in claim 1, wherein $R^5$ in the formula (1) or (2) represents an aryl group represented by the following formula (3):

(3)

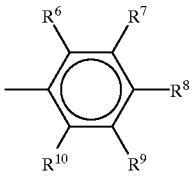

wherein $R^6$, $R^7$, $R^8$, $R^9$ and $R^{10}$, which may be the same or different, each represents a hydrogen atom, a halogen atom, a cyano group, a nitro group or an alkyl, heterocyclic, alkoxy, aryloxy, alkylthio, arylthio, alkylcarbonyl, arylcarbonyl, alkylsulfonyl, arylsulfonyl, alkylcarbonamido, arylcarbonamido, alkylsulfonamido, arylsulfonamido, alkylcarbonyloxy, arylcarbonyloxy, carbamoyl, alkylcarbamoyl, arylcarbamoyl, alkoxycarbonyl, aryloxycarbonyl, sulfamoyl, alkylsulfamoyl, arylsulfamoyl, ureido or urethane group having not more than 4 carbon atoms or an I/O value of not less than 1, or $R^6$ and $R^7$, $R^7$ and $R^8$, $R^8$ and $R^9$ or $R^9$ and $R^{10}$ may be combined each other to form a ring.

12. The heat developable color photographic light-sensitive material as claimed in claim 1, wherein the developing agent represented by the formula (1) or (2) has a halogen atom, a cyano group or a substituent having an I/O value of not less than 1 or having not more than 4 carbon atoms, at the position either or both of at least one of $R^1$ to $R^4$ and at least one of $R^6$ to $R^{10}$.

13. The heat developable color photographic light-sensitive material as claimed in claim 1, wherein at least one of $R^2$ and $R^4$ and at least one of $R^6$ and $R^{10}$ in the formula (1) each represents a substituent other than a hydrogen atom.

14. The heat developable color photographic light-sensitive material as claimed in claim 13, wherein at least one of $R^2$ and $R^4$ in formula (1) each represents a substituent other than a hydrogen atom.

15. The heat developable color photographic light-sensitive material as claimed in claim 1, wherein $R^4$ and $R^6$ and/or $R^{10}$ in the formula (2) each represents a substituent other than a hydrogen atom.

16. The heat developable color photographic light-sensitive material as claimed in claim 15, wherein $R^4$ in formula (2) represents a substituent other than a hydrogen atom.

17. The heat developable color photographic light-sensitive material as claimed in claim 1, wherein $R^1$ and $R^2$, $R^3$ and $R^4$, $R^6$ and $R^7$, $R^7$ and $R^8$, $R^8$ and $R^9$ or $R^9$ and $R^{10}$ in the formula (1) or (2) are substituents other than hydrogen atoms, and they are combined each other to form a ring, provided that the I/O value of the combination of the groups is not less than 1.

18. The heat developable color photographic light-sensitive material as claimed in claim 1, wherein the developing agent is a compound represented by the formula (1).

19. The heat developable color photographic light-sensitive material as claimed in claim 1, wherein an amount of the developing agent represented by the formula (1) or (2) is from 0.01% by mole to 2% by mole based on the dye providing compound represented by the formula (L1).

20. The heat developable color photographic light-sensitive material as claimed in claim 1 further comprising a light-sensitive silver halide emulsion.

* * * * *